US009573759B2

(12) United States Patent
Yang et al.

(10) Patent No.: US 9,573,759 B2
(45) Date of Patent: Feb. 21, 2017

(54) TRASH CAN

(71) Applicant: simplehuman, LLC, Torrance, CA (US)

(72) Inventors: Frank Yang, Rancho Palos Verdes, CA (US); Joseph Sandor, Newport Beach, CA (US)

(73) Assignee: simplehuman, LLC, Torrance, CA (US)

( * ) Notice: Subject to any disclaimer, the term of this patent is extended or adjusted under 35 U.S.C. 154(b) by 0 days.

(21) Appl. No.: 14/198,460

(22) Filed: Mar. 5, 2014

(65) Prior Publication Data

US 2014/0246434 A1 Sep. 4, 2014

Related U.S. Application Data

(63) Continuation of application No. 12/045,641, filed on Mar. 10, 2008, now Pat. No. 8,720,728.

(60) Provisional application No. 60/906,071, filed on Mar. 9, 2007.

(51) Int. Cl.

| | |
|---|---|
| ***B65D 90/00*** | (2006.01) |
| ***B65F 1/14*** | (2006.01) |
| *B65F 1/16* | (2006.01) |

(52) U.S. Cl.

CPC ..... *B65F 1/1623* (2013.01); *B65F 1/163* (2013.01); *B65F 1/1615* (2013.01); *B65F 1/1473* (2013.01); *B65F 2001/1661* (2013.01); *B65F 2220/12* (2013.01); *Y10T 29/49826* (2015.01)

(58) Field of Classification Search

CPC ..... B65F 1/163

USPC ..... 220/675, 323, 262, 810, 263, 324, 908, 220/326, 260, 315, 264, 827, 532, 529, 220/533

See application file for complete search history.

(56) References Cited

U.S. PATENT DOCUMENTS

| | | | |
|---|---|---|---|
| 830,182 | A | 9/1906 | Skov |
| 1,426,211 | A | 8/1922 | Pausin |
| 1,461,253 | A | 7/1923 | Obadiah |
| 1,754,802 | A | 4/1930 | Raster |
| 1,820,555 | A | 8/1931 | Buschman |
| 1,891,651 | A | 12/1932 | Padelford et al. |
| 1,922,729 | A | 8/1933 | Giebel |

(Continued)

FOREIGN PATENT DOCUMENTS

| | | |
|---|---|---|
| AU | 622536 | 4/1992 |
| AU | 365296 | 11/2015 |

(Continued)

OTHER PUBLICATIONS

U.S. Appl. No. 13/783,149, filed Mar. 1, 2013, Yang et al.

(Continued)

*Primary Examiner* — Jeffrey Allen

(74) *Attorney, Agent, or Firm* — Knobbe, Martens, Olson & Bear, LLP

(57) ABSTRACT

A trash can with a lid can include a lock for the lid. The lock can include a latch that cooperates with the trash container body to lock the lid over the opening of the body. The latch can be configured to slide with respect to the edge of the opening of the body from an unlocked position to a locked position. This latch can be integrated into, built into or self contained in the lid. The trash can can also include a pedal actuator for opening the lid. The trash can can also include a damping mechanism mounted to the body of the trash can with a mounting plate. The mounting plate can be made from (Continued)

a material that is harder than the material used for the body of the trash can. Additionally, the trash can can have wheels.

39 Claims, 17 Drawing Sheets

(56) References Cited

U.S. PATENT DOCUMENTS

| | | | | |
|---|---|---|---|---|
| 1,980,938 | A | | 11/1934 | Geibel |
| 2,308,326 | A | | 1/1943 | Calcagno |
| D148,825 | S | | 2/1948 | Snider |
| 2,457,274 | A | | 12/1948 | Rifken |
| 2,759,625 | A | | 8/1956 | Ritter |
| 2,796,309 | A | | 6/1957 | Taylor |
| 2,888,307 | A | | 5/1959 | Graves et al. |
| 2,946,474 | A | | 7/1960 | Knapp |
| 3,008,604 | A | | 11/1961 | Garner |
| 3,023,922 | A | | 3/1962 | Arrington et al. |
| 3,137,408 | A | | 6/1964 | Taylor |
| 3,300,082 | A | | 1/1967 | Patterson |
| 3,392,825 | A | | 7/1968 | Gale et al. |
| 3,451,453 | A | | 6/1969 | Heck |
| 3,654,534 | A | | 4/1972 | Fischer |
| 3,800,503 | A | | 4/1974 | Maki |
| 3,820,200 | A | | 6/1974 | Myers |
| 3,825,150 | A | | 7/1974 | Taylor |
| 3,825,215 | A | | 7/1974 | Borglum |
| 3,886,425 | A | | 5/1975 | Weiss |
| 3,888,406 | A | | 6/1975 | Nippes |
| 3,891,115 | A | | 6/1975 | Ono |
| 4,014,457 | A | | 3/1977 | Hodge |
| 4,027,774 | A | | 6/1977 | Cote |
| 4,081,105 | A | | 3/1978 | Dagonnet et al. |
| 4,189,808 | A | | 2/1980 | Brown |
| 4,200,197 | A | | 4/1980 | Meyer et al. |
| 4,217,616 | A | | 8/1980 | Jessup |
| 4,303,174 | A | | 12/1981 | Anderson |
| 4,320,851 | A | | 3/1982 | Montoya |
| 4,349,123 | A | | 9/1982 | Yang |
| 4,357,740 | A | | 11/1982 | Brown |
| 4,416,197 | A | | 11/1983 | Kehl |
| 4,417,669 | A | | 11/1983 | Knowles et al. |
| 4,457,483 | A | | 7/1984 | Gagne |
| 4,535,911 | A | | 8/1985 | Goulter |
| 4,570,304 | A | | 2/1986 | Montreuil et al. |
| 4,576,310 | A | | 3/1986 | Isgar et al. |
| D284,320 | S | | 6/1986 | Kubic et al. |
| 4,609,117 | A | | 9/1986 | Pamment |
| 4,630,332 | A | | 12/1986 | Bisbing |
| 4,630,752 | A | | 12/1986 | DeMars |
| 4,664,347 | A | | 5/1987 | Brown et al. |
| 4,697,312 | A | | 10/1987 | Freyer |
| 4,711,161 | A | | 12/1987 | Swin et al. |
| 4,729,490 | A | | 3/1988 | Ziegenbein |
| 4,753,367 | A | | 6/1988 | Miller et al. |
| 4,763,808 | A | | 8/1988 | Guhl et al. |
| 4,765,548 | A | | 8/1988 | Sing |
| 4,765,579 | A | | 8/1988 | Robbins et al. |
| 4,785,964 | A | * | 11/1988 | Miller et al. ..... 220/263 |
| 4,792,039 | A | | 12/1988 | Dayton |
| 4,794,973 | A | | 1/1989 | Perisic |
| 4,813,592 | A | | 3/1989 | Stolzman |
| 4,823,979 | A | | 4/1989 | Clark, Jr. |
| 4,834,260 | A | | 5/1989 | Auten |
| 4,863,053 | A | | 9/1989 | Oberg |
| 4,867,339 | A | | 9/1989 | Hahn |
| 4,869,391 | A | | 9/1989 | Farrington |
| 4,884,717 | A | | 12/1989 | Bussard et al. |
| 4,888,532 | A | | 12/1989 | Josson |
| 4,892,223 | A | | 1/1990 | DeMent |
| 4,892,224 | A | | 1/1990 | Graham |
| 4,913,308 | A | | 4/1990 | Culbertson |
| 4,915,347 | A | | 4/1990 | Iqbal et al. |
| 4,918,568 | A | | 4/1990 | Stone et al. |
| D308,272 | S | | 5/1990 | Koepsell |
| 4,923,087 | A | | 5/1990 | Burrows |
| 4,944,419 | A | | 7/1990 | Chandler |
| 4,948,004 | A | | 8/1990 | Chich |
| 4,964,523 | A | | 10/1990 | Bieltvedt et al. |
| 4,972,966 | A | | 11/1990 | Craft, Jr. |
| 4,996,467 | A | | 2/1991 | Day |
| 5,031,793 | A | | 7/1991 | Chen et al. |
| 5,048,903 | A | | 9/1991 | Loblein |
| 5,054,724 | A | | 10/1991 | Hutcheson |
| 5,065,272 | A | | 11/1991 | Owen et al. |
| 5,065,891 | A | | 11/1991 | Casey |
| 5,076,462 | A | | 12/1991 | Perrone |
| D323,573 | S | | 1/1992 | Schneider |
| 5,090,585 | A | | 2/1992 | Power |
| 5,090,785 | A | | 2/1992 | Stamp |
| 5,100,087 | A | | 3/1992 | Ashby |
| 5,111,958 | A | | 5/1992 | Witthoeft |
| D327,760 | S | | 7/1992 | Donnelly |
| D329,929 | S | | 9/1992 | Knoedler et al. |
| 5,147,055 | A | | 9/1992 | Sampson et al. |
| 5,156,290 | A | | 10/1992 | Rodrigues |
| 5,170,904 | A | | 12/1992 | Neuhaus |
| 5,174,462 | A | | 12/1992 | Hames |
| D335,562 | S | | 5/1993 | Evans |
| 5,213,272 | A | | 5/1993 | Gallagher et al. |
| 5,222,704 | A | | 6/1993 | Light |
| D337,181 | S | | 7/1993 | Warman |
| 5,226,558 | A | | 7/1993 | Whitney et al. |
| 5,230,525 | A | | 7/1993 | Delmerico et al. |
| 5,242,074 | A | | 9/1993 | Conaway et al. |
| D340,333 | S | | 10/1993 | Duran et al. |
| 5,249,693 | A | | 10/1993 | Gillispie et al. |
| 5,261,553 | A | | 11/1993 | Mueller et al. |
| 5,265,511 | A | | 11/1993 | Itzov |
| 5,295,607 | A | | 3/1994 | Chang |
| 5,305,916 | A | | 4/1994 | Suzuki et al. |
| 5,314,151 | A | | 5/1994 | Carter-Mann |
| 5,322,179 | A | | 6/1994 | Ting |
| 5,329,212 | A | | 7/1994 | Feigleson |
| 5,348,222 | A | | 9/1994 | Patey |
| 5,353,950 | A | | 10/1994 | Taylor et al. |
| 5,372,272 | A | | 12/1994 | Jennings |
| 5,381,588 | A | | 1/1995 | Nelson |
| 5,385,258 | A | | 1/1995 | Sutherlin |
| 5,390,818 | A | | 2/1995 | LaBuda |
| 5,404,621 | A | | 4/1995 | Heinke |
| 5,407,089 | A | | 4/1995 | Bird et al. |
| 5,419,452 | A | | 5/1995 | Mueller et al. |
| 5,471,708 | A | | 12/1995 | Lynch |
| 5,474,201 | A | | 12/1995 | Liu |
| 5,501,358 | A | | 3/1996 | Hobday |
| 5,520,067 | A | | 5/1996 | Gaba |
| 5,520,303 | A | | 5/1996 | Bernstein et al. |
| 5,531,348 | A | | 7/1996 | Baker et al. |
| 5,535,913 | A | | 7/1996 | Asbach et al. |
| 5,558,254 | A | | 9/1996 | Anderson et al. |
| 5,584,412 | A | | 12/1996 | Wang |
| D377,554 | S | | 1/1997 | Adriaansen |
| 5,611,507 | A | | 3/1997 | Smith |
| 5,628,424 | A | | 5/1997 | Gola |
| 5,632,401 | A | | 5/1997 | Hurd |
| 5,636,416 | A | | 6/1997 | Anderson |
| 5,636,761 | A | | 6/1997 | Diamond et al. |
| 5,644,111 | A | | 7/1997 | Cerny et al. |
| 5,645,186 | A | | 7/1997 | Powers et al. |
| 5,650,680 | A | | 7/1997 | Chula |
| D383,277 | S | | 9/1997 | Peters |
| 5,662,235 | A | | 9/1997 | Nieto |
| 5,671,847 | A | | 9/1997 | Pedersen et al. |
| 5,690,247 | A | | 11/1997 | Boover |
| 5,695,088 | A | | 12/1997 | Kasbohm |
| 5,699,929 | A | | 12/1997 | Ouno |
| D388,922 | S | | 1/1998 | Peters |
| D389,631 | S | | 1/1998 | Peters |
| 5,704,511 | A | | 1/1998 | Kellams |
| 5,724,837 | A | | 3/1998 | Shin |
| 5,730,312 | A | | 3/1998 | Hung |
| 5,732,845 | A | | 3/1998 | Armaly, Jr. |
| 5,735,495 | A | | 4/1998 | Kubota |

(56) References Cited

U.S. PATENT DOCUMENTS

| | | | |
|---|---|---|---|
| 5,738,239 | A | 4/1998 | Triglia |
| 5,770,935 | A | 6/1998 | Smith et al. |
| 5,799,909 | A | 9/1998 | Ziegler |
| 5,816,431 | A | 10/1998 | Giannopoulos |
| 5,816,640 | A | 10/1998 | Nishimura |
| D401,383 | S | 11/1998 | Gish |
| D401,719 | S | 11/1998 | Van Leeuwen et al. |
| 5,873,643 | A | 2/1999 | Burgess, Jr. et al. |
| 5,881,896 | A | 3/1999 | Presnell et al. |
| 5,881,901 | A | 3/1999 | Hampton |
| 5,884,237 | A | 3/1999 | Kanki et al. |
| 5,887,748 | A | 3/1999 | Nguyen |
| 5,961,105 | A | 10/1999 | Ehrnsberger et al. |
| 5,967,392 | A | 10/1999 | Niemi et al. |
| 5,987,708 | A | 11/1999 | Newton |
| 6,000,569 | A | 12/1999 | Liu |
| 6,010,024 | A | 1/2000 | Wang |
| 6,024,238 | A | 2/2000 | Jaros |
| 6,036,050 | A | 3/2000 | Ruane |
| 6,102,239 | A | 8/2000 | Wien |
| 6,105,859 | A | 8/2000 | Stafford |
| 6,123,215 | A | 9/2000 | Windle |
| D431,700 | S | 10/2000 | Roudebush |
| 6,126,031 | A | 10/2000 | Reason |
| 6,129,233 | A | 10/2000 | Schiller |
| 6,131,861 | A | 10/2000 | Fortier, Jr. et al. |
| D435,951 | S | 1/2001 | Yang et al. |
| 6,209,744 | B1 | 4/2001 | Gill |
| 6,211,637 | B1 | 4/2001 | Studer |
| 6,234,339 | B1 | 5/2001 | Thomasd |
| 6,250,492 | B1 | 6/2001 | Verbeek |
| D445,980 | S | 7/2001 | Tjugum |
| 6,286,706 | B1 | 9/2001 | Tucker |
| 6,328,320 | B1 | 12/2001 | Walski et al. |
| 6,345,725 | B1 | 2/2002 | Lin |
| 6,364,147 | B1 | 4/2002 | Meinzinger et al. |
| 6,386,386 | B1 | 5/2002 | George |
| 6,390,321 | B1 | 5/2002 | Wang |
| 6,401,958 | B1 | 6/2002 | Foss et al. |
| 6,519,130 | B1 | 2/2003 | Breslow |
| 6,557,716 | B1 | 5/2003 | Chan |
| D476,456 | S | 6/2003 | Englert et al. |
| 6,596,983 | B2 | 7/2003 | Brent |
| 6,626,316 | B2 | 9/2003 | Yang |
| 6,626,317 | B2 | 9/2003 | Pfiefer et al. |
| 6,632,064 | B1 | 10/2003 | Walker et al. |
| D482,169 | S | 11/2003 | Lin |
| 6,659,407 | B2 | 12/2003 | Asaro |
| 6,681,950 | B2 | 1/2004 | Miller, Jr. et al. |
| D488,604 | S | 4/2004 | Yang et al. |
| D488,903 | S | 4/2004 | Yang et al. |
| D489,503 | S | 5/2004 | Lin |
| D489,857 | S | 5/2004 | Yang et al. |
| D490,583 | S | 5/2004 | Yang et al. |
| D490,954 | S | 6/2004 | Brand |
| D491,706 | S | 6/2004 | Yang et al. |
| 6,758,366 | B2 | 7/2004 | Bourgund et al. |
| D493,930 | S | 8/2004 | Wang |
| D494,723 | S | 8/2004 | Lin |
| 6,812,655 | B1 | 11/2004 | Wang et al. |
| 6,814,249 | B2 | 11/2004 | Lin |
| D499,450 | S | 12/2004 | Goodman et al. |
| 6,837,393 | B1 | 1/2005 | Kuo |
| 6,857,538 | B2 | 2/2005 | Lin |
| 6,859,005 | B2 | 2/2005 | Boliver |
| D503,021 | S | 3/2005 | Yang et al. |
| 6,866,826 | B2 | 3/2005 | Moore et al. |
| 6,883,676 | B2 | 4/2005 | Lin |
| D507,090 | S | 7/2005 | Yang et al. |
| 6,920,994 | B2 | 7/2005 | Lin |
| 6,974,948 | B1 | 12/2005 | Brent |
| D513,445 | S | 1/2006 | Lin |
| 6,981,606 | B2 | 1/2006 | Yang et al. |
| D517,764 | S | 3/2006 | Wang |
| D517,767 | S | 3/2006 | Yang et al. |
| D518,266 | S | 3/2006 | Yang et al. |
| 7,017,773 | B2 | 3/2006 | Gruber et al. |
| 7,044,323 | B2 | 5/2006 | Yang et al. |
| D525,756 | S | 7/2006 | Yang et al. |
| 7,073,677 | B2 | 7/2006 | Richardson et al. |
| 7,077,283 | B2 | 7/2006 | Yang et al. |
| 7,080,750 | B2 | 7/2006 | Wein et al. |
| 7,086,550 | B2 | 8/2006 | Yang et al. |
| D528,726 | S | 9/2006 | Lin |
| 7,121,421 | B2 | 10/2006 | Yang et al. |
| D531,499 | S | 11/2006 | Zaidman |
| D535,799 | S | 1/2007 | Epps |
| D535,800 | S | 1/2007 | Yang et al. |
| 7,163,591 | B2 | 1/2007 | Kim et al. |
| 7,168,591 | B1 | 1/2007 | Miller |
| D537,223 | S | 2/2007 | Lin |
| D537,599 | S | 2/2007 | Lin |
| D537,601 | S | 2/2007 | Lin |
| D537,999 | S | 3/2007 | Lin |
| D538,995 | S | 3/2007 | Lin |
| D539,498 | S | 3/2007 | Yang et al. |
| D539,499 | S | 3/2007 | Yang et al. |
| D540,001 | S | 4/2007 | Zimmerman |
| D542,001 | S | 5/2007 | Yang et al |
| D542,995 | S | 5/2007 | Lin |
| D543,673 | S | 5/2007 | Yang et al. |
| D544,170 | S | 6/2007 | Lin |
| D544,171 | S | 6/2007 | Lin |
| D544,671 | S | 6/2007 | Saunders et al. |
| D545,024 | S | 6/2007 | Liao |
| 7,225,943 | B2 | 6/2007 | Yang et al. |
| D547,020 | S | 7/2007 | Chen |
| 7,243,811 | B1 | 7/2007 | Ramsey |
| D550,918 | S | 9/2007 | Wang et al. |
| D552,319 | S | 10/2007 | Gusdorf |
| D552,321 | S | 10/2007 | Yang et al. |
| D552,823 | S | 10/2007 | Yang et al. |
| D552,824 | S | 10/2007 | Zimmerman |
| D552,825 | S | 10/2007 | Yang et al. |
| D555,320 | S | 11/2007 | Yang et al. |
| D559,494 | S | 1/2008 | Yang et al. |
| D559,495 | S | 1/2008 | Yang et al. |
| D562,522 | S | 2/2008 | Daams |
| 7,328,842 | B2 | 2/2008 | Wagner et al. |
| D564,169 | S | 3/2008 | Wang |
| D564,723 | S | 3/2008 | Yang et al. |
| D566,367 | S | 4/2008 | Lin |
| D566,369 | S | 4/2008 | Shek |
| D566,923 | S | 4/2008 | Lin |
| D567,468 | S | 4/2008 | Yang et al. |
| D568,572 | S | 5/2008 | Yang et al. |
| 7,374,060 | B2 | 5/2008 | Yang et al. |
| D571,520 | S | 6/2008 | Lin |
| 7,395,990 | B1 | 7/2008 | Stevens |
| 7,398,913 | B2 | 7/2008 | McClure |
| 7,404,499 | B1 | 7/2008 | Ramsey |
| D574,569 | S | 8/2008 | Yang et al. |
| D576,371 | S | 9/2008 | Zimmerman |
| D578,265 | S | 10/2008 | Presnell |
| D578,266 | S | 10/2008 | Yang et al. |
| D578,268 | S | 10/2008 | Yang et al. |
| D578,722 | S | 10/2008 | Yang et al. |
| 7,438,199 | B1 | 10/2008 | Tidrick |
| D580,120 | S | 11/2008 | Lin |
| D580,613 | S | 11/2008 | Yang et al. |
| D580,615 | S | 11/2008 | Yang et al. |
| D581,622 | S | 11/2008 | Presnell et al. |
| D584,470 | S | 1/2009 | Bizzell et al. |
| D585,171 | S | 1/2009 | Bizzell et al. |
| D585,618 | S | 1/2009 | Yang et al. |
| D586,070 | S | 2/2009 | Lin |
| 7,494,021 | B2 | 2/2009 | Yang et al. |
| D587,874 | S | 3/2009 | Lin |
| D593,271 | S | 5/2009 | Yang et al. |
| 7,540,396 | B2 | 6/2009 | Yang et al. |
| 7,543,716 | B2 | 6/2009 | Lin |
| 7,559,433 | B2 | 7/2009 | Yang et al. |
| D599,074 | S | 8/2009 | Bizzell et al. |
| D603,119 | S | 10/2009 | Yang et al. |

(56) References Cited

U.S. PATENT DOCUMENTS 7,607,552 B2 10/2009 Efstathiou
D604,472 S 11/2009 Blanks et al.
7,614,519 B2 11/2009 Krauth et al.
7,621,420 B2 11/2009 Bandoh et al.
7,656,109 B2 2/2010 Yang et al.
D611,216 S 3/2010 Yang et al.
D611,217 S 3/2010 Bizzell et al.
D611,671 S 3/2010 Yang et al.
7,694,838 B2 4/2010 Yang et al.
7,703,622 B1 4/2010 Bynoe
D615,270 S 5/2010 Yang et al.
D615,722 S 5/2010 Yang et al.
7,712,285 B2 5/2010 Stravitz et al.
7,741,801 B2 6/2010 Fukuizumi
7,748,556 B2 7/2010 Yang et al.
7,781,995 B2 8/2010 Yang et al.
D623,817 S 9/2010 Yang et al.
D625,068 S 10/2010 Shannon
7,806,285 B2 10/2010 Yang et al.
D627,533 S 11/2010 Yang et al.
D627,944 S 11/2010 Wang et al.
D629,172 S 12/2010 Liao
D630,404 S 1/2011 Yang et al.
D631,221 S 1/2011 Yang et al.
D632,864 S 2/2011 Yang et al.
D634,911 S 3/2011 Yang et al.
D635,319 S 3/2011 Meyerhoffer
7,896,187 B2 3/2011 Haibel
7,922,024 B2 4/2011 Yang et al.
7,950,543 B2 5/2011 Yang et al.
D644,390 S 8/2011 Smeets et al.
7,992,742 B1 8/2011 Kim
8,006,857 B2 8/2011 Lin
D644,806 S 9/2011 Yang et al.
D644,807 S 9/2011 Yang et al.
D649,728 S 11/2011 Campbell
8,074,833 B2 12/2011 Yang et al.
8,136,688 B2 3/2012 Lee et al.
D657,108 S 4/2012 Yang et al.
D657,109 S 4/2012 Liao
8,297,470 B2 10/2012 Yang et al.
8,317,055 B2 11/2012 Zawrotny et al.
D672,520 S 12/2012 Yang et al.
D673,750 S 1/2013 Quan
D675,802 S 2/2013 Yang et al.
D675,803 S 2/2013 Yang et al.
8,418,869 B2 4/2013 Yang et al.
D689,255 S 9/2013 Sun Ting Kung et al.
8,567,630 B2 10/2013 Yang et al.
8,569,980 B2 10/2013 Yang et al.
8,575,537 B2 11/2013 Yao et al.
8,672,171 B2 3/2014 Wynn et al.
8,678,219 B1 3/2014 Wang et al.
8,686,676 B2 4/2014 Yang et al.
8,716,969 B2 5/2014 Yang et al.
8,720,728 B2 5/2014 Yang et al.
8,766,582 B2 7/2014 Yang et al.
8,807,378 B2 8/2014 Kaberna
8,807,379 B1 8/2014 Hammond
D714,510 S 9/2014 Yang et al.
D716,015 S 10/2014 van de Leest
8,851,316 B2 10/2014 Barrett et al.
8,872,459 B2 10/2014 Yang et al.
D725,861 S 3/2015 Yang et al.
D730,008 S 5/2015 Yang et al.
9,051,093 B2 6/2015 Yang et al.
D759,934 S 6/2016 Yang et al.
9,434,538 B2 9/2016 Yang et al.
2001/0002690 A1 6/2001 Rosky
2001/0020619 A1 9/2001 Pfeifer et al.
2002/0066736 A1 6/2002 Pyles
2002/0092853 A1 7/2002 Wang
2002/0096523 A1 7/2002 Pyles
2002/0096524 A1 7/2002 Hardesty
2002/0104266 A1 8/2002 Ranaudo
2002/0116924 A1 8/2002 Winkelmann et al.
2003/0089719 A1 5/2003 Berger
2003/0102316 A1 6/2003 Forest
2003/0201265 A1 10/2003 Lin
2003/0201267 A1* 10/2003 Yang et al. ..... 220/263
2003/0205979 A1 11/2003 Papari et al.
2003/0230576 A1 12/2003 Lin
2004/0016756 A1* 1/2004 Lin ..... 220/263
2004/0134924 A1 7/2004 Hansen et al.
2004/0140782 A1 7/2004 Okabe et al.
2004/0164077 A1 8/2004 Kuo
2004/0174268 A1 9/2004 Scott et al.
2004/0175303 A1 9/2004 Lin
2004/0199401 A1 10/2004 Wagner
2004/0200938 A1 10/2004 Forlivio
2004/0206758 A1 10/2004 Lin
2004/0206760 A1 10/2004 Gagnebin
2004/0251746 A1 12/2004 Ichimaru et al.
2005/0017006 A1 1/2005 Kuo
2005/0017010 A1 1/2005 Siegel et al.
2005/0029281 A1 2/2005 Westermann et al.
2005/0258177 A1 11/2005 Woodson
2005/0258794 A1 11/2005 Fukuizumi
2006/0027579 A1 2/2006 Yang et al.
2006/0103086 A1 5/2006 Niemeyer et al.
2006/0138149 A1 6/2006 Tracy
2006/0163257 A1 7/2006 Golbert
2006/0175336 A1 8/2006 Wang
2006/0186121 A1 8/2006 Yang et al.
2006/0196874 A1 9/2006 Yang
2006/0237641 A1 10/2006 Moeller et al.
2006/0249510 A1 11/2006 Lin
2006/0278643 A1 12/2006 Chiou
2007/0012699 A1 1/2007 Yang et al.
2007/0034334 A1 2/2007 Ramsey et al.
2007/0045326 A1 3/2007 Tramontina et al.
2007/0090112 A1 4/2007 Kalman et al.
2007/0114847 A1 5/2007 Ichimaru et al.
2007/0181579 A1 8/2007 Kuo et al.
2007/0182551 A1 8/2007 Yang et al.
2007/0205195 A1 9/2007 Yang et al.
2007/0209846 A1 9/2007 Wilson
2007/0215622 A1 9/2007 Perez
2007/0241109 A1 10/2007 Lin
2007/0266637 A1 11/2007 McGowan
2007/0272691 A1 11/2007 Wang et al.
2007/0289972 A1 12/2007 Wynn et al.
2008/0011754 A1 1/2008 Ramsey
2008/0011910 A1 1/2008 Ramsey
2008/0041863 A1 2/2008 Forest
2008/0083756 A1 4/2008 Daniels
2008/0083757 A1 4/2008 Parker et al.
2008/0099274 A1 5/2008 Seel
2008/0128428 A1 6/2008 Beckerman
2008/0164257 A1 7/2008 Boll et al.
2008/0236275 A1 10/2008 Breed et al.
2008/0237234 A1 10/2008 Yang et al.
2008/0257889 A1 10/2008 Kovacevich et al.
2008/0257890 A1 10/2008 Kovacevich et al.
2008/0257891 A1 10/2008 Kovacevich et al.
2008/0264948 A1 10/2008 Kovacevich et al.
2008/0264950 A1 10/2008 Kovacevich et al.
2008/0272119 A1 11/2008 Efstathiou
2008/0272127 A1 11/2008 Kovacevich et al.
2009/0084788 A1 4/2009 Yang et al.
2009/0136341 A1 5/2009 Kenyon
2009/0194532 A1 8/2009 Yang et al.
2009/0230131 A1 9/2009 McDuffie et al.
2009/0261105 A1 10/2009 Cunningham et al.
2009/0266836 A1 10/2009 Mobley
2010/0006572 A1 1/2010 Chiou
2010/0084235 A1 4/2010 Lu
2010/0096894 A1 4/2010 Fukai
2010/0122985 A1 5/2010 Peters et al.
2010/0147865 A1 6/2010 Yang et al.
2010/0170904 A1 7/2010 Kalman et al.
2010/0237074 A1 9/2010 Yang et al.
2010/0252557 A1 10/2010 Clements
2010/0294769 A1 11/2010 Lee et al.

(56) References Cited

U.S. PATENT DOCUMENTS

| | | | |
|---|---|---|---|
| 2011/0017735 | A1 | 1/2011 | Wang et al. |
| 2011/0049149 | A1 | 3/2011 | Shih |
| 2011/0139781 | A1 | 6/2011 | Jin et al. |
| 2011/0220646 | A1 | 9/2011 | Yang et al. |
| 2011/0220647 | A1 | 9/2011 | Yang et al. |
| 2011/0220648 | A1 | 9/2011 | Yang et al. |
| 2011/0220655 | A1 | 9/2011 | Yang et al. |
| 2011/0272409 | A1 | 11/2011 | Kasbohm |
| 2012/0234849 | A1 | 9/2012 | Hughes et al. |
| 2012/0261423 | A1 | 10/2012 | Zawrotny et al. |
| 2013/0098913 | A1 | 4/2013 | Yang et al. |
| 2013/0105487 | A1 | 5/2013 | Baik |
| 2013/0233853 | A1 | 9/2013 | Yang et al. |
| 2013/0233857 | A1 | 9/2013 | Yang et al. |
| 2013/0240592 | A1 | 9/2013 | Woodruff |
| 2013/0248532 | A1 | 9/2013 | Yang et al. |
| 2013/0248535 | A1 | 9/2013 | Wolfe et al. |
| 2013/0300119 | A1 | 11/2013 | Anzalon et al. |
| 2014/0183193 | A1 | 7/2014 | Hammond et al. |
| 2014/0246432 | A1 | 9/2014 | Yang et al. |
| 2014/0345453 | A1 | 11/2014 | Oh et al. |
| 2015/0251849 | A1 | 9/2015 | Yang et al. |
| 2015/0259139 | A1 | 9/2015 | Yang et al. |
| 2015/0259140 | A1 | 9/2015 | Yang et al. |
| 2015/0321841 | A1 | 11/2015 | Salas et al. |

FOREIGN PATENT DOCUMENTS

| | | | |
|---|---|---|---|
| CA | 2519295 | | 3/2007 |
| CA | 132181 | | 6/2010 |
| CA | 136938 | | 5/2011 |
| CA | 141819 | | 4/2012 |
| CA | 146601 | | 2/2013 |
| CA | 152797 | | 4/2014 |
| CA | 158595 | | 4/2015 |
| CA | 158685 | | 4/2015 |
| CN | 102190144 | A | 9/2011 |
| CN | 301947175 | S | 6/2012 |
| CN | 103300590 | A | 9/2013 |
| CN | 302771721 | S | 3/2014 |
| CN | 104016030 | A | 9/2014 |
| CN | 303188855 | S | 4/2015 |
| CN | 303206241 | S | 5/2015 |
| CN | 303611394 | S | 3/2016 |
| CN | 303622098 | S | 3/2016 |
| DE | 1610087 | | 6/1950 |
| DE | 1610087 | | 7/1950 |
| DE | 822376 | | 11/1951 |
| DE | 1283741 | | 7/1966 |
| DE | 8436939 | | 3/1985 |
| DE | 9108341 | | 10/1991 |
| DE | 4225936 | A1 | 2/1994 |
| DE | 19525885 | | 3/1997 |
| DE | 19617823 | | 11/1997 |
| DE | 19809331 | | 5/1999 |
| DE | 29918687 | | 3/2000 |
| DE | 19933180 | | 1/2001 |
| DE | 10148997 | | 4/2003 |
| DE | 20217561 | | 3/2004 |
| EP | 0582240 | | 7/1993 |
| EP | 0903305 | A1 | 3/1999 |
| EP | 0906876 | A2 | 4/1999 |
| EP | 1094017 | | 4/2001 |
| EP | 1136393 | | 4/2001 |
| EP | 1361176 | | 11/2003 |
| EP | 1447342 | A2 | 8/2004 |
| EP | 1600373 | A2 | 11/2005 |
| EP | 1647503 | A1 | 4/2006 |
| EP | 1686073 | A1 | 8/2006 |
| EP | 1918223 | A1 | 5/2008 |
| EP | 1700799 | B1 | 8/2009 |
| EP | 001164826-0001 | | 9/2009 |
| EP | 001232904-0001 | | 10/2010 |
| EP | 2343250 | A1 | 7/2011 |
| EP | 001908575-0001 | | 8/2011 |
| EP | 001317416-0001 | | 4/2012 |
| EP | 001317416-0002 | | 4/2012 |
| EP | 001335285-0001 | | 7/2012 |
| EP | 001335293-0001 | | 7/2012 |
| EP | 001381636-001 | | 8/2013 |
| EP | 001381792-0001 | | 8/2013 |
| EP | 2636611 | A1 | 9/2013 |
| EP | 2636613 | A1 | 9/2013 |
| EP | 001420590-0001 | | 9/2014 |
| EP | 2772454 | A2 | 9/2014 |
| EP | 2915763 | A1 | 9/2015 |
| EP | 2918518 | A2 | 9/2015 |
| EP | 002766782-0001 | | 11/2015 |
| EP | 002766782-0002 | | 11/2015 |
| EP | 002766881-0001 | | 11/2015 |
| EP | 2364932 | B1 | 4/2016 |
| FR | 2887152 | | 12/2006 |
| GB | 191004921 | | 6/1910 |
| GB | 2384418 | | 7/2003 |
| JP | 02-152670 | | 6/1990 |
| JP | H06-56011 | | 8/1994 |
| JP | 06-272888 | | 9/1994 |
| JP | D1300450 | | 5/2007 |
| JP | D1300451 | | 5/2007 |
| JP | D1322056 | | 2/2008 |
| JP | D1398668 | | 10/2010 |
| JP | D1550907 | | 4/2016 |
| JP | D1551184 | | 4/2016 |
| KR | 3003841370000 | | 6/2005 |
| KR | 3004095430000 | | 3/2006 |
| KR | 3004095430001 | | 7/2006 |
| NL | 6908550 | | 12/1970 |
| TW | D112733 | | 9/2006 |
| TW | D129485 | | 7/2009 |
| TW | D133382 | | 2/2010 |
| TW | D133678 | | 3/2010 |
| TW | D147147 | | 5/2012 |
| TW | D154797 | | 7/2013 |
| TW | D158187 | | 1/2014 |
| TW | D161587 | | 7/2014 |
| TW | D168957 | | 7/2015 |
| TW | D170334 | | 9/2015 |
| TW | 201538406 | | 10/2015 |
| TW | D176312 | | 6/2016 |
| TW | D176313 | | 6/2016 |
| WO | WO 92/02430 | | 2/1992 |
| WO | WO 96/33671 | | 10/1996 |
| WO | WO 2005/080232 | A1 | 9/2005 |
| WO | WO 2006/079263 | | 8/2006 |
| WO | WO 2007/139570 | A2 | 12/2007 |
| WO | WO 2009/114495 | | 9/2009 |
| WO | WO 2015/134902 | A1 | 9/2015 |
| WO | WO 2015/138625 | A1 | 9/2015 |
| WO | WO 2016/054109 | A1 | 4/2016 |

OTHER PUBLICATIONS

U.S. Appl. No. 29/447,313, filed Mar. 1, 2013, Yang et al.

European Search Report for Application No. EP 10002273, dated Jan. 4, 2011, in 9 pages.

European Search Report for European Application No. EP 06010394, dated Aug. 27, 2006, in 1 page.

Partial European Search Report for Application No. EP 10002273, dated Jul. 2, 2010, in 5 pages.

Search Report for Taiwan Design Patent Application No. 097304453, dated Apr. 22, 2009.

Search Report for Taiwan Design Patent Application No. 099304439, dated Jul. 1, 2011, in 1 page.

Trento Corner 23 Trash Can, Hailo product brochure. http://www.hailo.de/html/default.asp?site=12_71_107&lang=en.

U.S. Appl. No. 29/484,903, filed Mar. 13, 2014, Yang et al.

U.S. Appl. No. 29/484,764, filed Mar. 1, 2013, Yang et al.

U.S. Appl. No. 14/637,270, filed Mar. 4, 2015, Yang et al.

U.S. Appl. No. 14/639,049, filed Mar. 4, 2015, Yang et al.

U.S. Appl. No. 14/639,862, filed Mar. 5, 2015.

U.S. Appl. No. 29/519,549, filed Mar. 5, 2015.

U.S. Appl. No. 29/519,551, filed Mar. 5, 2015.

(56) References Cited

OTHER PUBLICATIONS

U.S. Appl. No. 14/856,309, filed Sep. 26, 2015.
U.S. Appl. No. 29/548,018, filed Dec. 9, 2015, Yang et al.
U.S. Appl. No. 29/557,032, filed Mar. 4, 2016, Yang et al.
U.S. Appl. No. 29/557,088, filed Mar. 4, 2016, Yang et al.

* cited by examiner

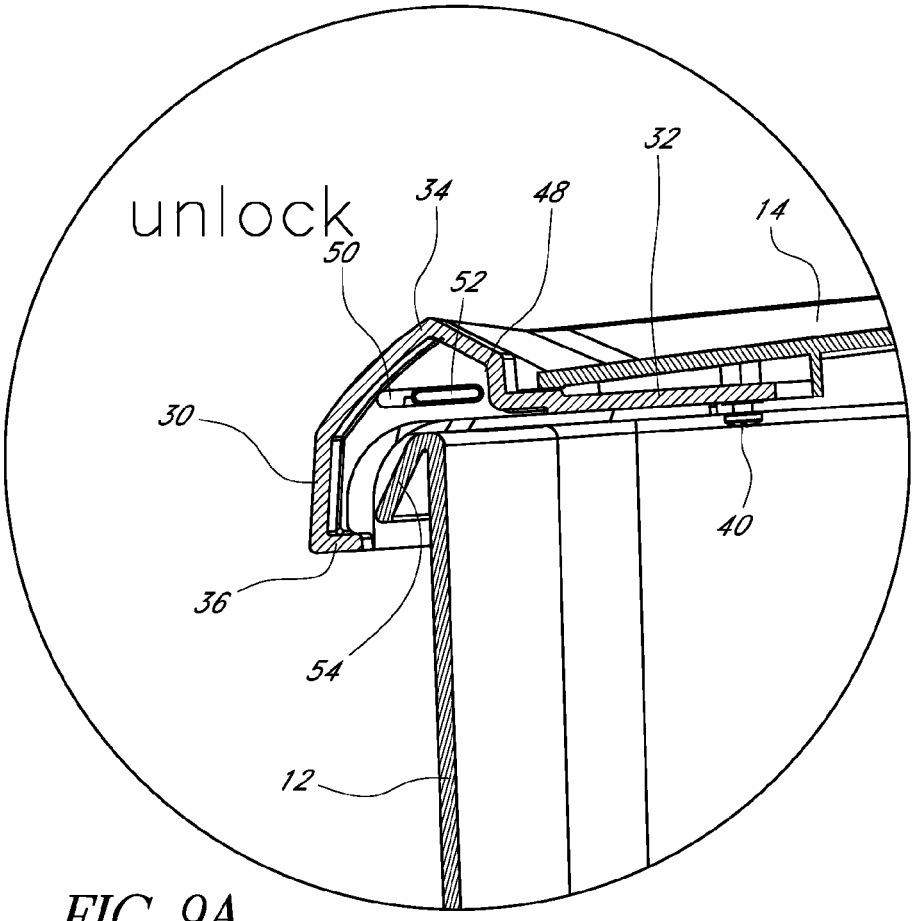
FIG. 9A
FIG. 9B
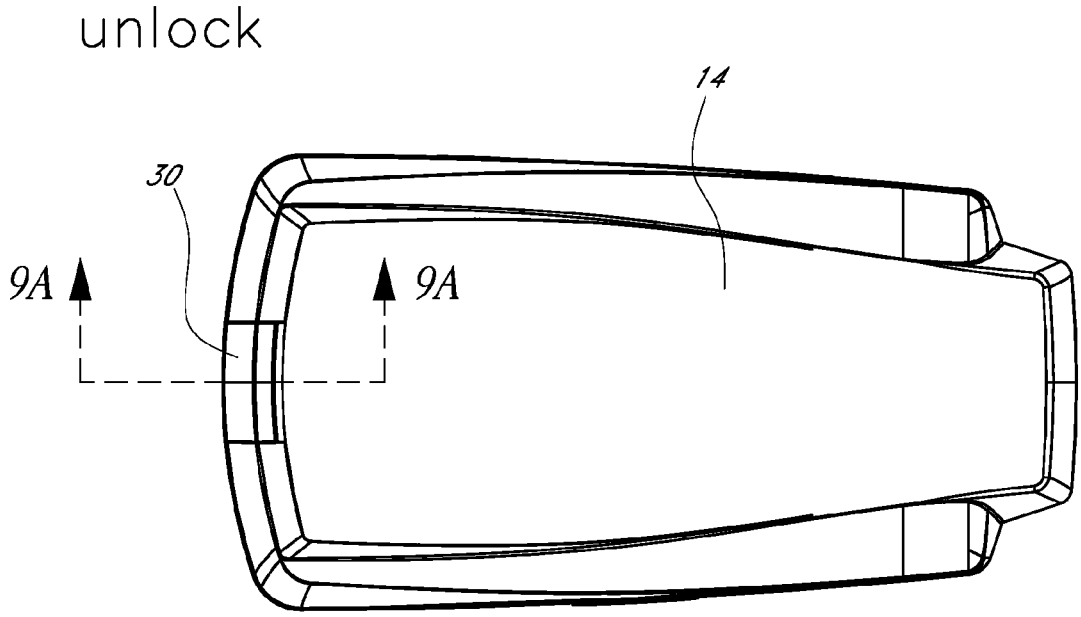

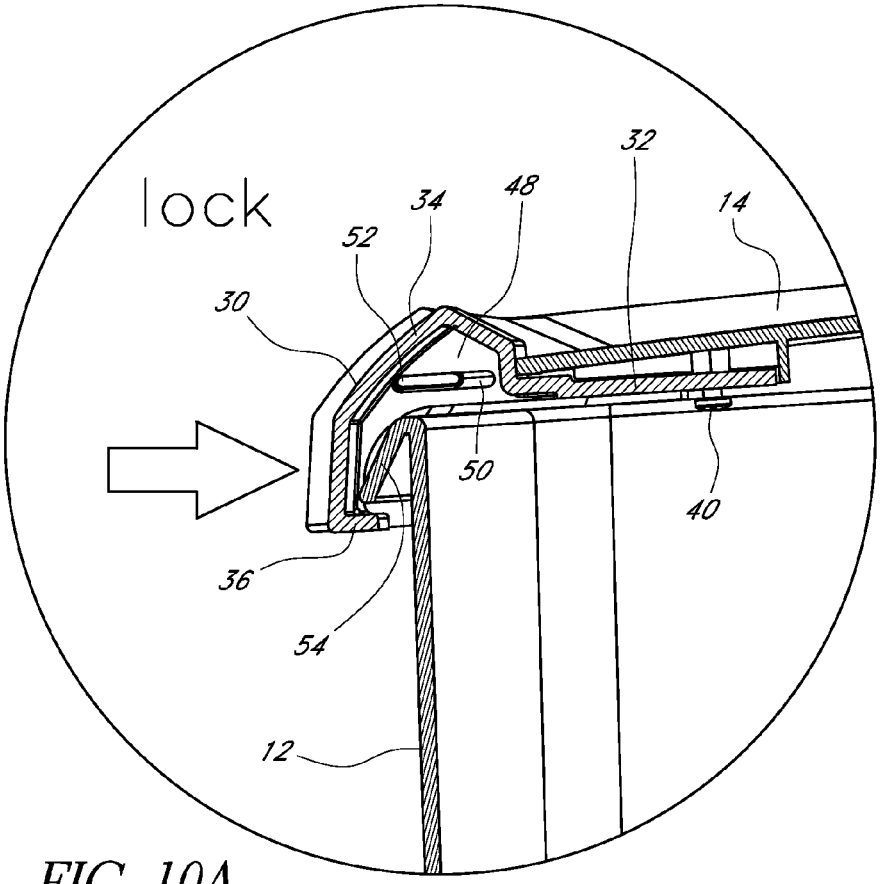
FIG. 10A
FIG. 10B
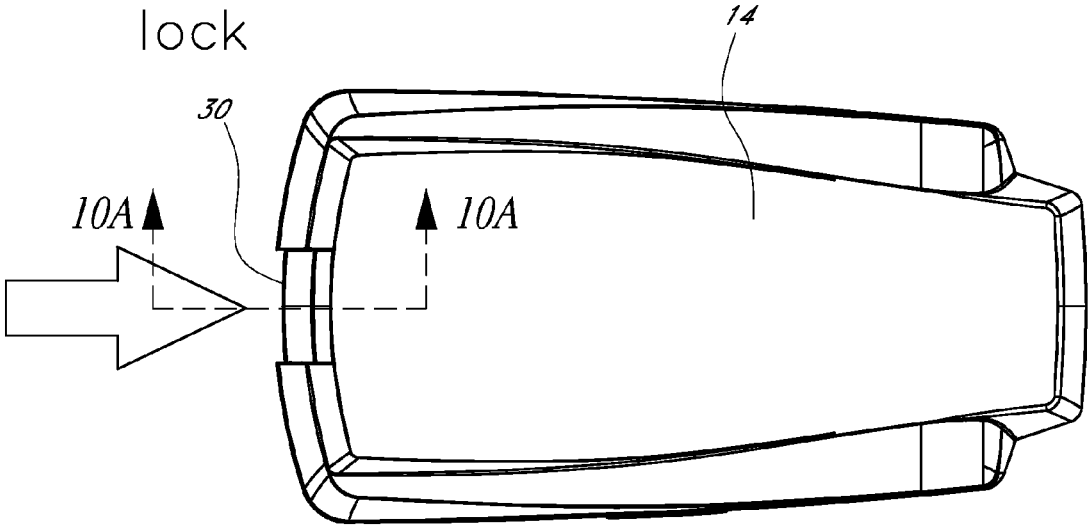

TRASH CAN

PRIORITY INFORMATION

This application is a continuation of U.S. patent application Ser. No. 12/045,641, filed Mar. 10, 2008, which claims priority to the U.S. Provisional Patent Application No. 60/906,071, filed Mar. 9, 2007, the entire contents of which is hereby incorporated by reference.

BACKGROUND OF THE INVENTIONS

Field of the Inventions

The present inventions are directed to lid mechanisms, such as those for trash containers.

Description of the Related Art

Receptacles and other devices having lids or doors are used in a variety of different settings. For example, in both residential and commercial settings, trash cans and other devices often have lids or doors for protecting or preventing the escape of the contents of the receptacle. In the context of trash cans, some trash cans include lids or doors to prevent odors from escaping and to hide the trash within the receptacle from view. Additionally, the lid of a trash can help prevent contamination from escaping from the receptacle.

Recently, trash cans with rotary-type motion dampers for slowing the motion of the lids have become commercially available. More specifically, these rotary dampening mechanisms are connected to the lids of the trash cans so as to slow the closing movement of the lids. As such, the trash can is more aesthetically pleasing because the lid closes slowly, thereby preventing a loud slamming noise when the lid is moved to a closing position.

These types of trash cans often are pedal-actuated, i.e., they include a foot pedal which is connected to the lid for moving the lid toward the open position. The rotary mechanisms are connected to the internal linkage connecting the foot pedal to the lid so as to slow the closing movement of the lid.

SUMMARY OF THE INVENTIONS

An aspect of at least on the embodiments disclosed herein includes the realization that including locking mechanism on the lid of a trash can can overcome certain problems associated with trash can lids. For example, toddlers or pets can accidentally knock over trash cans, thereby allowing the contents to spill out. Aside from accidents, toddlers and pets can also simply decide to explore the contents of the trash container, to their parents' or owners' dismay.

Thus, in accordance with an embodiment, a trash container can comprise a trash can body defining an interior cavity configured to receive trash, the trash can body can have an upper opening through which trash can be inserted into the interior cavity, the trash can body can also including a ledge disposed along at least a portion of an upper periphery of the upper opening, at least a portion of the ledge projecting from a side wall of the trash can body. A lid assembly can be pivotally attached to the trash can body so as to move between opened position and closed positions. The lid assembly can comprise a lid member sized to cover substantially the entire upper opening of the trash can body, at least a portion of the lid member can be spaced from the upper opening when the lid assembly is in the opened position, the lid member covering substantially the entire upper opening when the lid assembly is in the closed position. A latch mechanism can be supported by the lid and can comprise a slidable latch member mounted so as to be slidable relative to the lid member. The latch member can be slidable from a first position in which the latch member engages the ledge so as to lock the lead in the closed position and a second position in which the latch member does not engage the ledge.

Another aspect of at least one of the embodiments disclosed herein includes the realization that when mounting a motion dampening device, such as those used for dampening the motion of a lid of a trash can, to a plastic structure, difficulties can arise in the ability of the plastic material to withstand the forces generated in the vicinity of the dampened device. For example, plastic trash cans are often made from softer, more malleable plastics to allow them to withstand the typical treatment of trash cans (e.g., being overstuffed and deformed by an excess of trash). However, mounting a dampening device to such material presents difficulties in that when large forces are applied to the dampening device, which can be quite small and thus can concentrate such forces, the dampening device can be twisted or moved away from its original position, thereby interfering with the dampening process.

Thus, in accordance with an embodiment, a trash can can comprise a trash can body defining an interior volume configured to receive trash. The trash can body can include an upper opening sized such that trash can be inserted through the upper opening into the interior volume, the trash can body formed from a first material. A lid assembly can be pivotally attached relative to the trash can body so as to be movable between opened and closed positions. The lid assembly can comprise a lid member sized to cover substantially the entire upper opening when the lid assembly is in the closed position. An opening mechanism can be configured to move the lid assembly from the closed to the opened position. A dampening device can be configured to dampen movement of the lid assembly at least from the open position toward the closed position. The dampening device can be mounted to the trash can body with a mounting member, the mounting member made from a second material that is stiffer than the first material.

BRIEF DESCRIPTION OF THE DRAWINGS

These and other features and advantages of the present embodiments will become more apparent upon reading the following detailed description and with reference to the accompanying drawings of the embodiments, in which:

FIG. 9A is a detail sectional view of the step trash can taken along line 9A-9A in FIG. 91B with the lid latch in the unlock position; FIG. 9B is a top view of the lid with the latch in the unlock position.

FIG. 10A is a top view of the step trash can taken along line 10A-10A in FIG. 10B, with the lid latch in the lock position; FIG. 10B is a top view of the lid with the latch in the lock position.

DETAILED DESCRIPTION OF THE PREFERRED EMBODIMENTS

Figure 1:
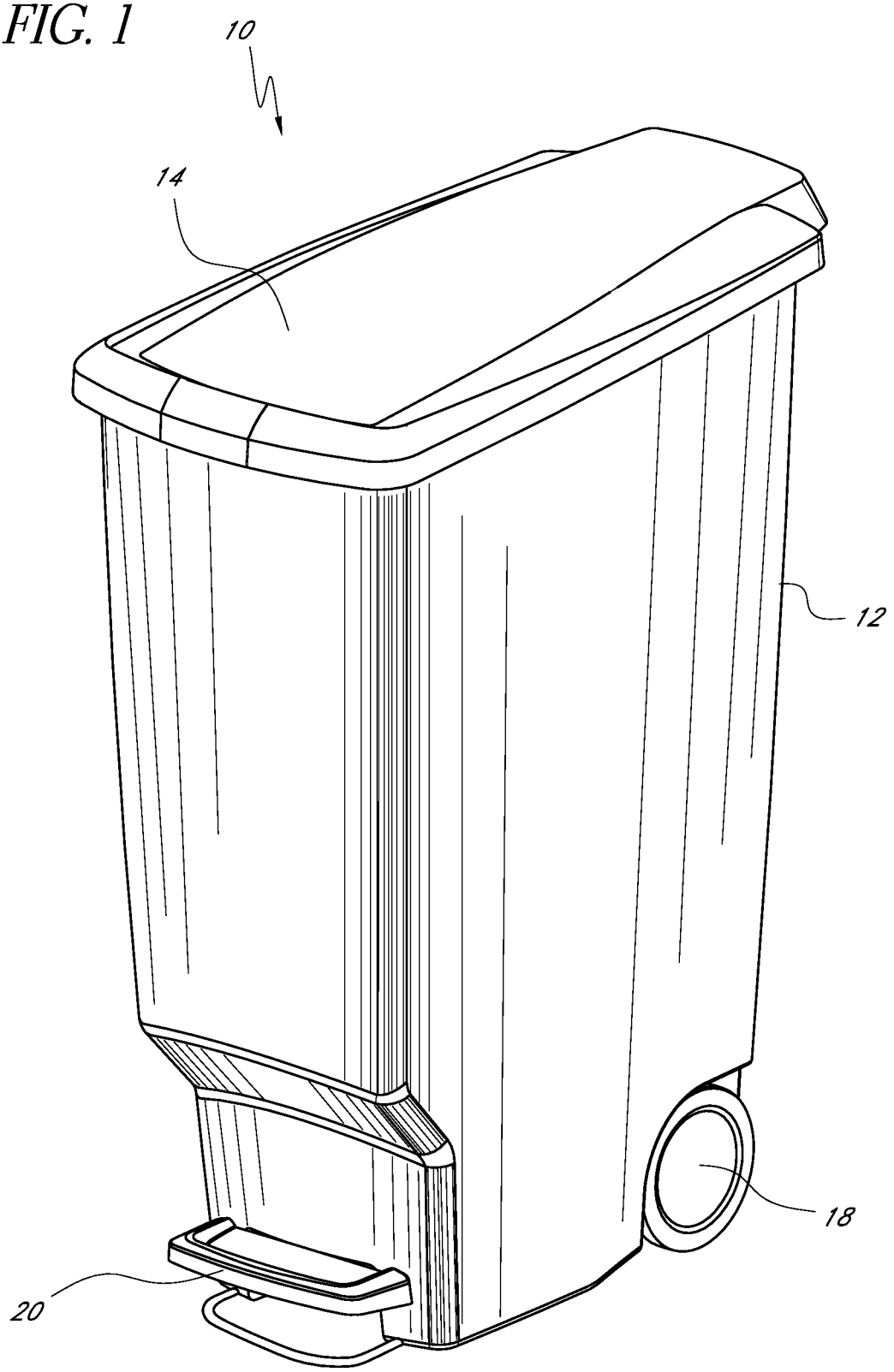
FIG. 1 is a right perspective view of a step trash can in accordance with an embodiment.
Figure 2:
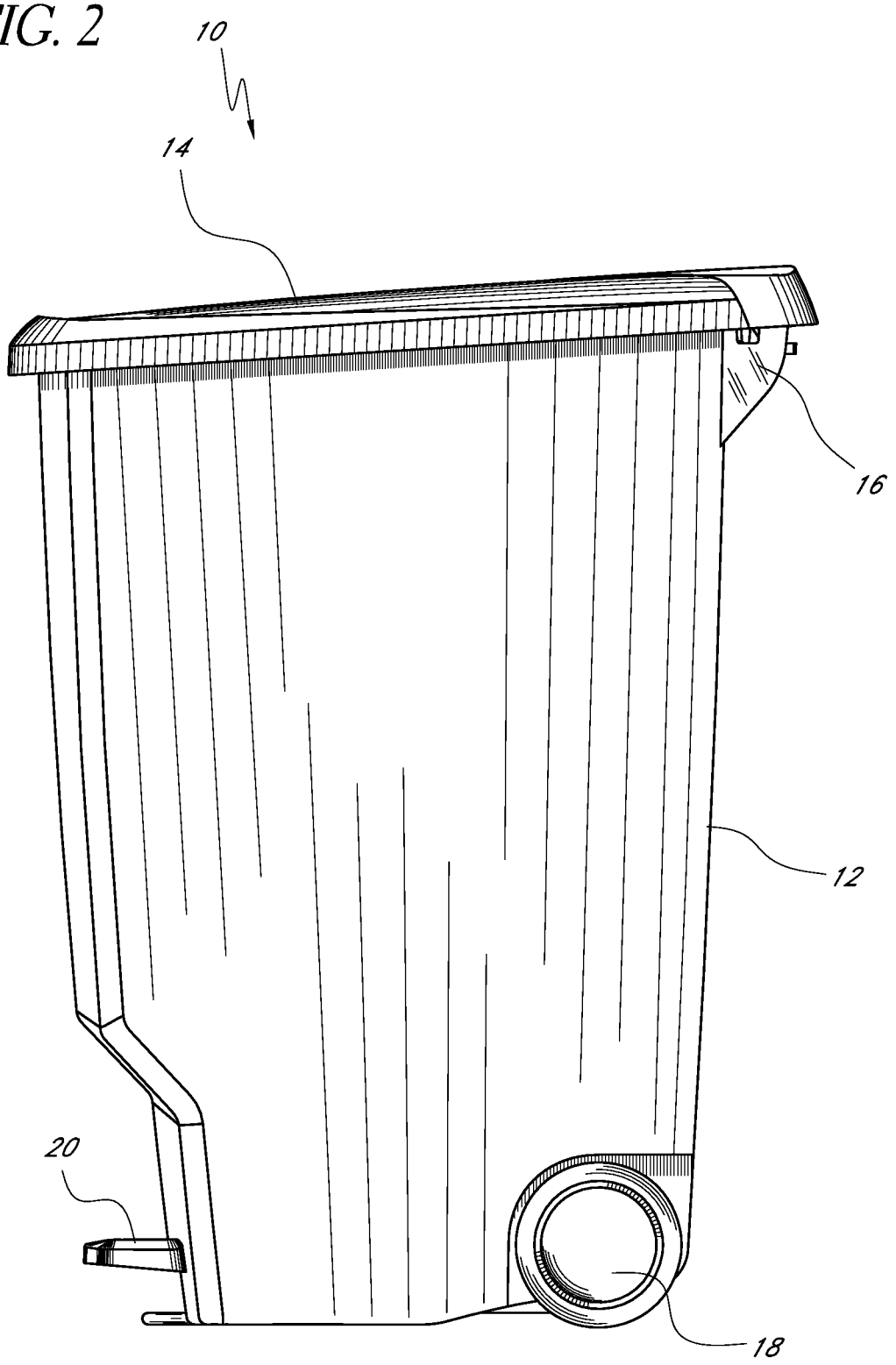
FIG. 2 is a right side view thereof.
Figure 3:
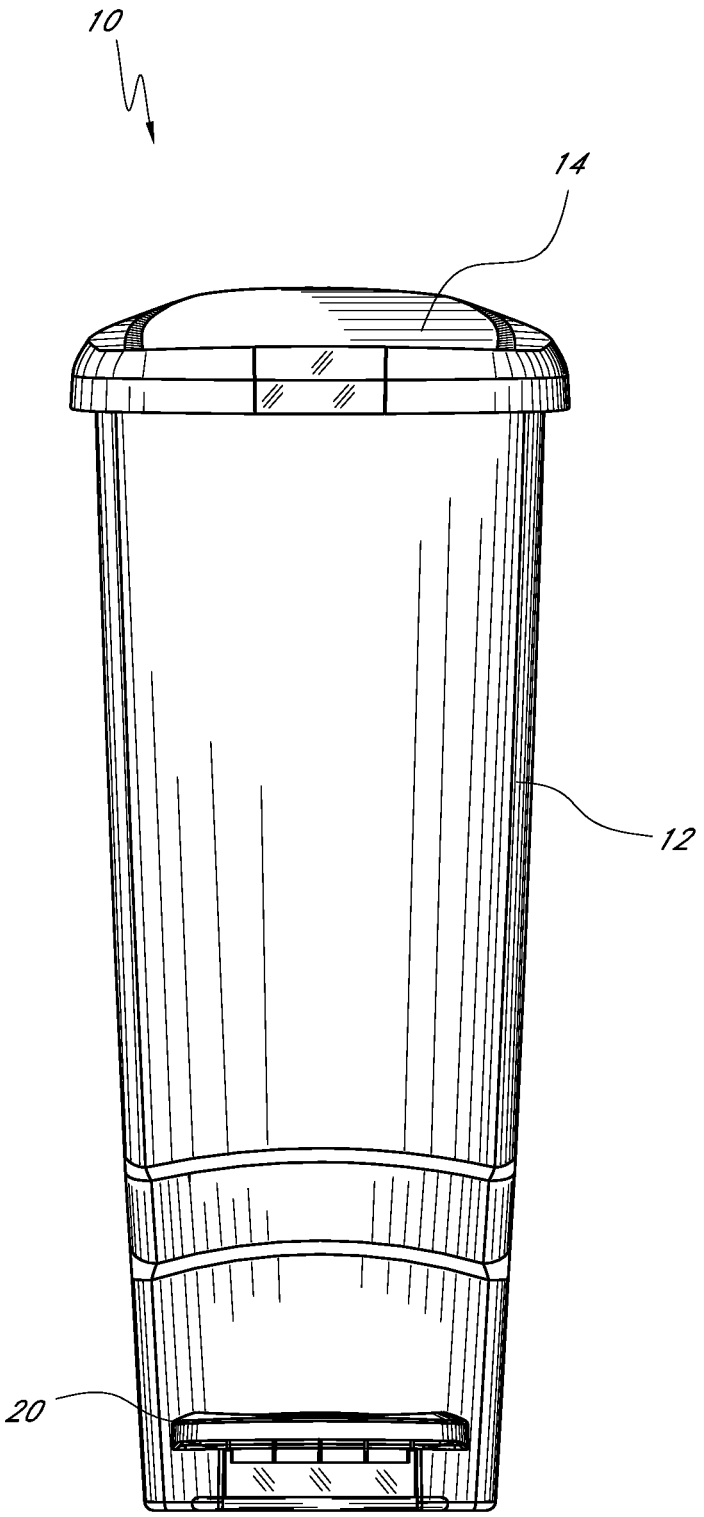
FIG. 3 is a front view thereof.

The inventions disclosed herein are disclosed in the context of a trash can because they have particular utility in this context. However, the inventions disclosed herein can be used in other contexts as well. Further, the inventions are described herein in reference to various embodiments and drawings. It will be appreciated by those skilled in the art that variations and improvements may be accomplished in view of these teachings without deviating from the scope and spirit of the invention. By way of illustration, the present inventions are described in reference to a step-type trash container, or a step trash can of the kind typically used in kitchens, for example. Other types of trash containers, with pivoted lids or removable lids can be used in connection with the present inventions.

With reference to the drawings, a latch can be included on the lid of a trash container, which can latch onto the edge of the trash container body to lock the lid to the edge of the opening of the body, securely covering the opening. FIGS. 1-7 illustrate the external views of a step trash can 10 in accordance with one embodiment of the present invention.

The step trash can 10 can generally have a body 12 and a lid 14 pivotally supported relative to the body. For example, the lid 14 can be hinged to the rear top edge of the body 12, by a hinge 16 shown in FIG. 2. A pair of wheels 18 can be provided to facilitate moving the step trash can 10 along a rolling surface.

A lid actuator system, which can also be referred to as an opening mechanism, can be provided at the rear of the step trash can 10 to activate pivotal opening of the lid 14 (see FIG. 5), the lid actuator system can include a foot piece (or "pedal") 20 located near the front base of the body 12. Linkages 22 (see FIG. 5) and 24 (see FIG. 7) which can include a lever member 24 and lifting rod, described in greater detail below, can cooperate to move the lid to 14 from a closed to an open position. Other than the embodiment of lid actuator system illustrated, other lid actuator system known in the art may be deployed without departing from the scope and spirit of the present inventions. The lid 14 can include a lid latch 30, which can be integrated into, built into or self contained in the lid (as opposed to a separate external locking piece for the lid).

In some embodiments, the latch 30 can be configured to slide with respect to the edge of the opening of the body from an unlocked position to a locked position. The sliding support interface between the latch and the lid can be provided with structures (e.g., indent and complementary locking tabs) that positively index the latch in the locked and unlocked positions. However, other configurations can also be used.

Figure 11:
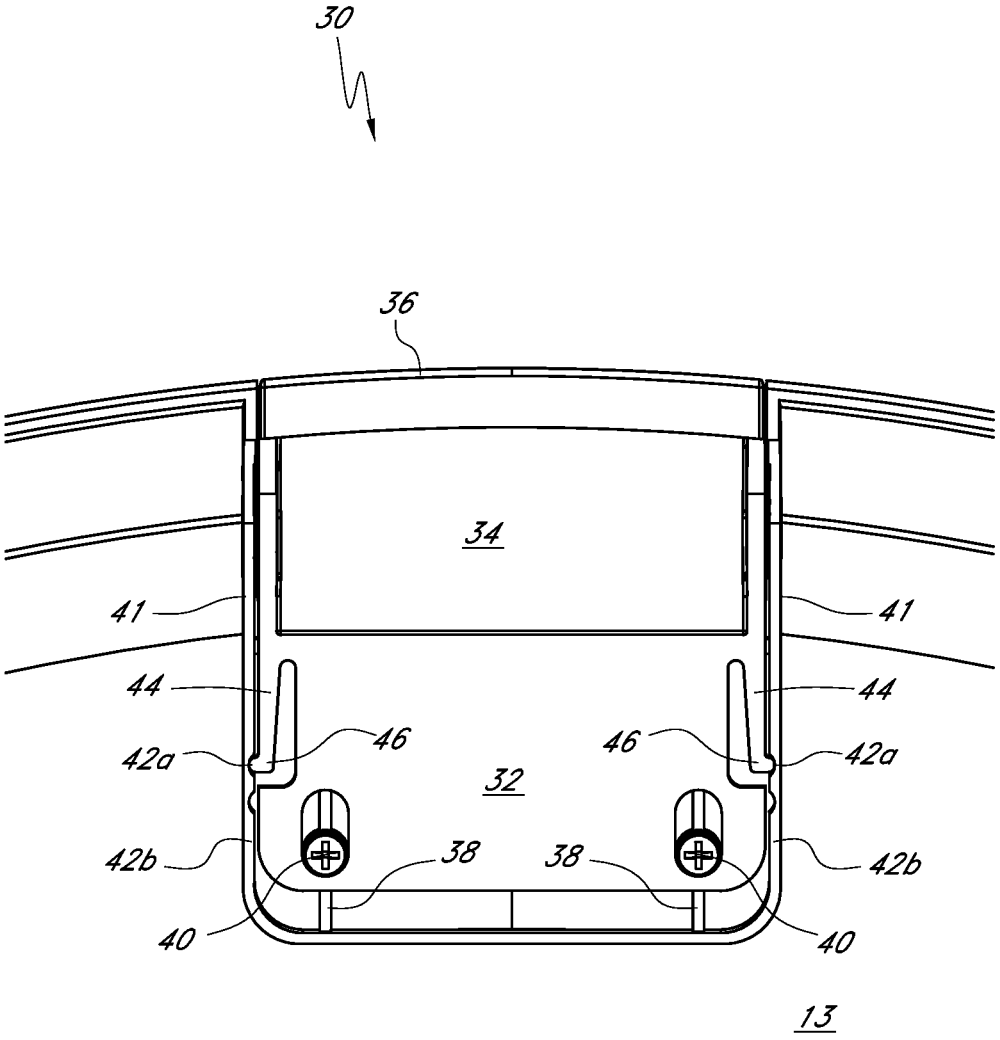
FIG. 11 is a plan view of the underside of the lid with the latch in the unlock position.
Figure 12:
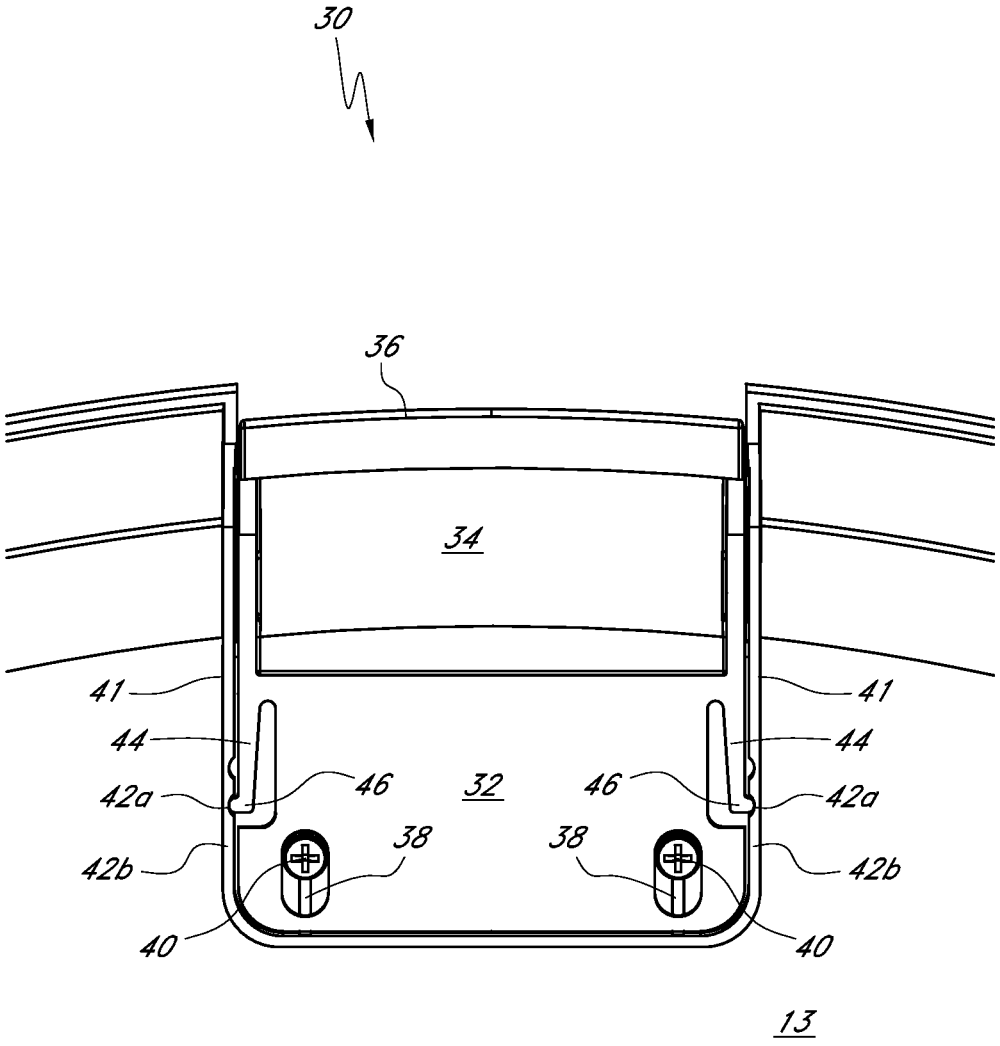
FIG. 12 is a plan view of the underside of the lid with the latch in the lock position.
Figure 13:
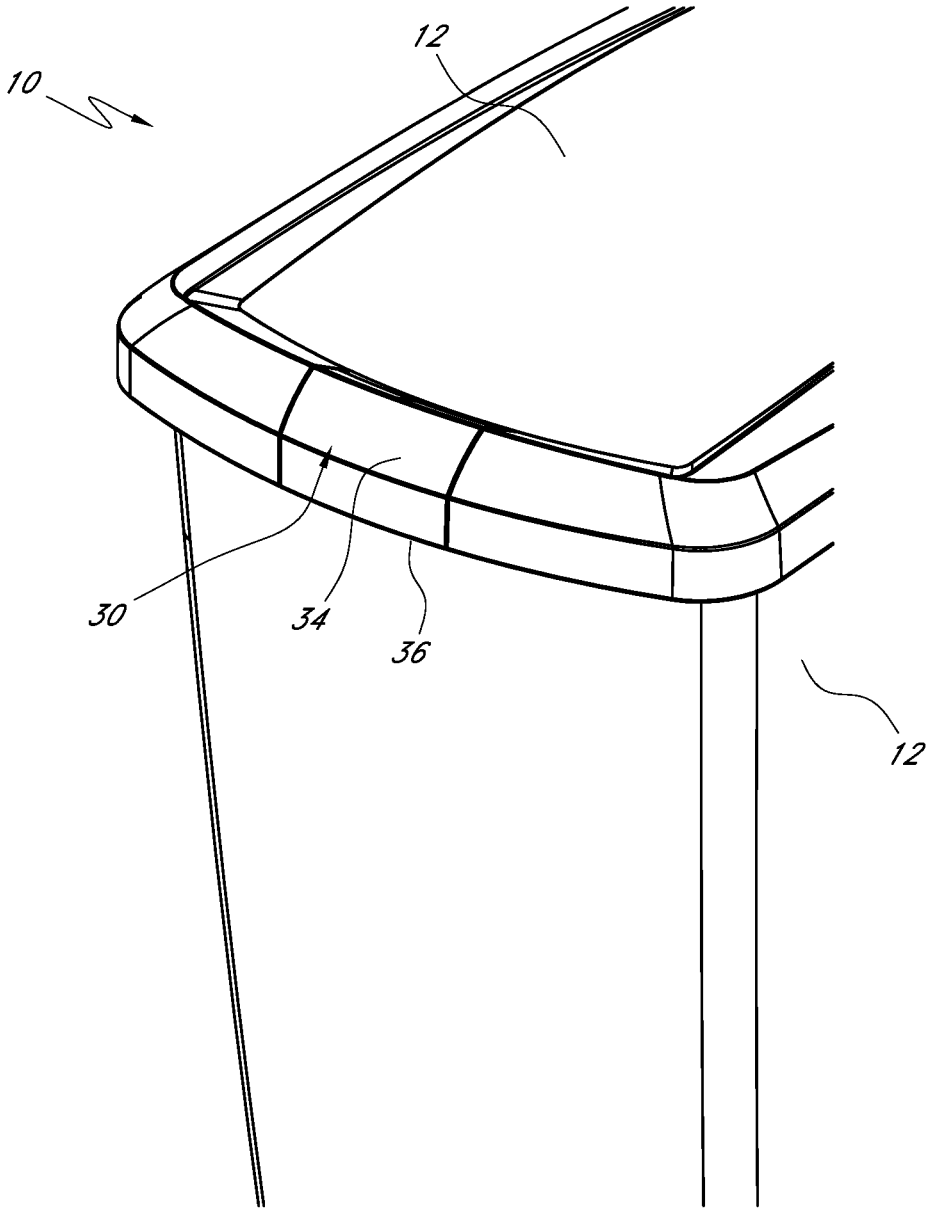
FIG. 13 is a top perspective view of the lid with the latch in the unlock position.
Figure 14:
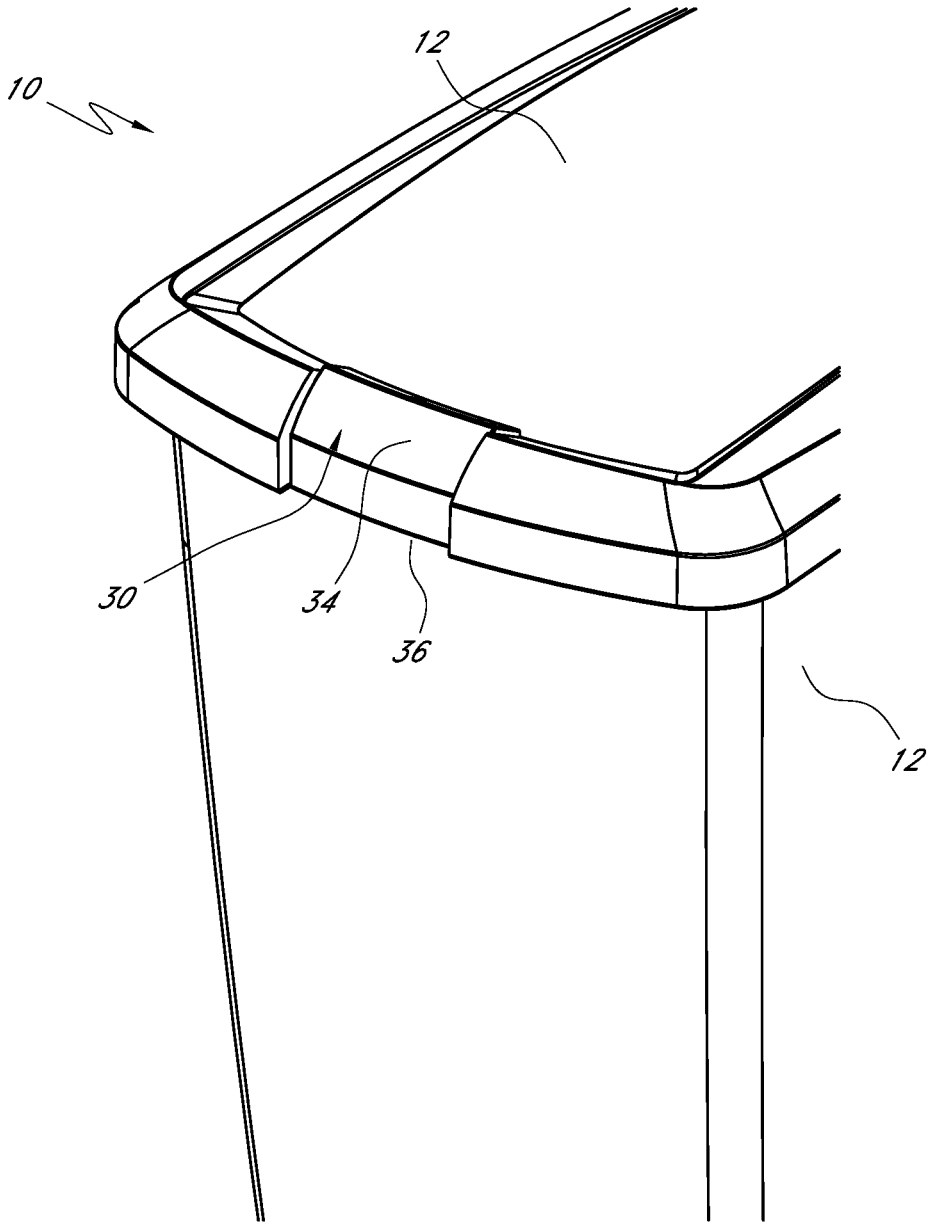
FIG. 14 is a top perspective view of the lid with the latch in the lock position.
Figure 15:
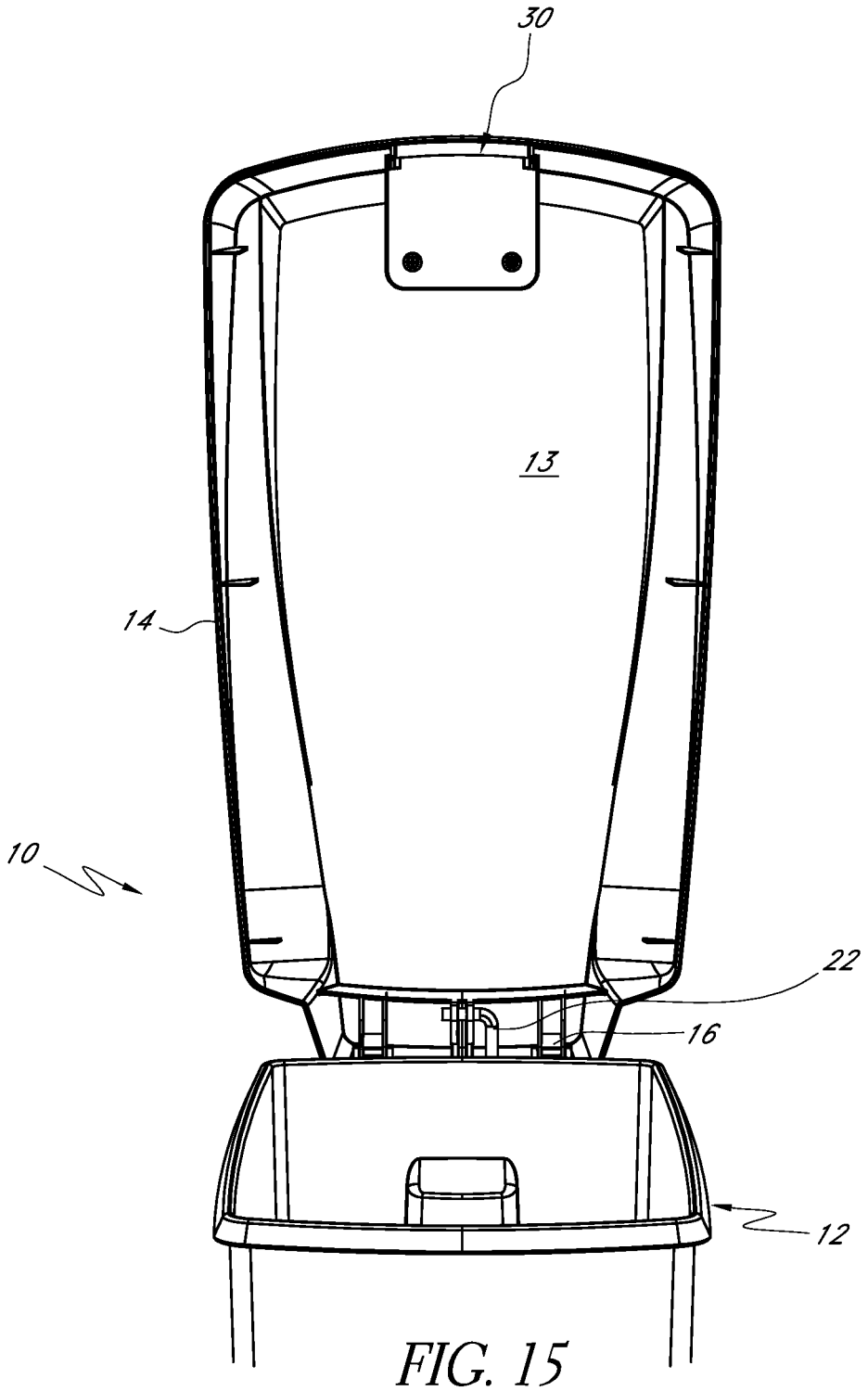
FIG. 15 is a front perspective view of the step trash can with the lid open, showing the underside of the lid with the latch in the unlock position.
Figure 16:
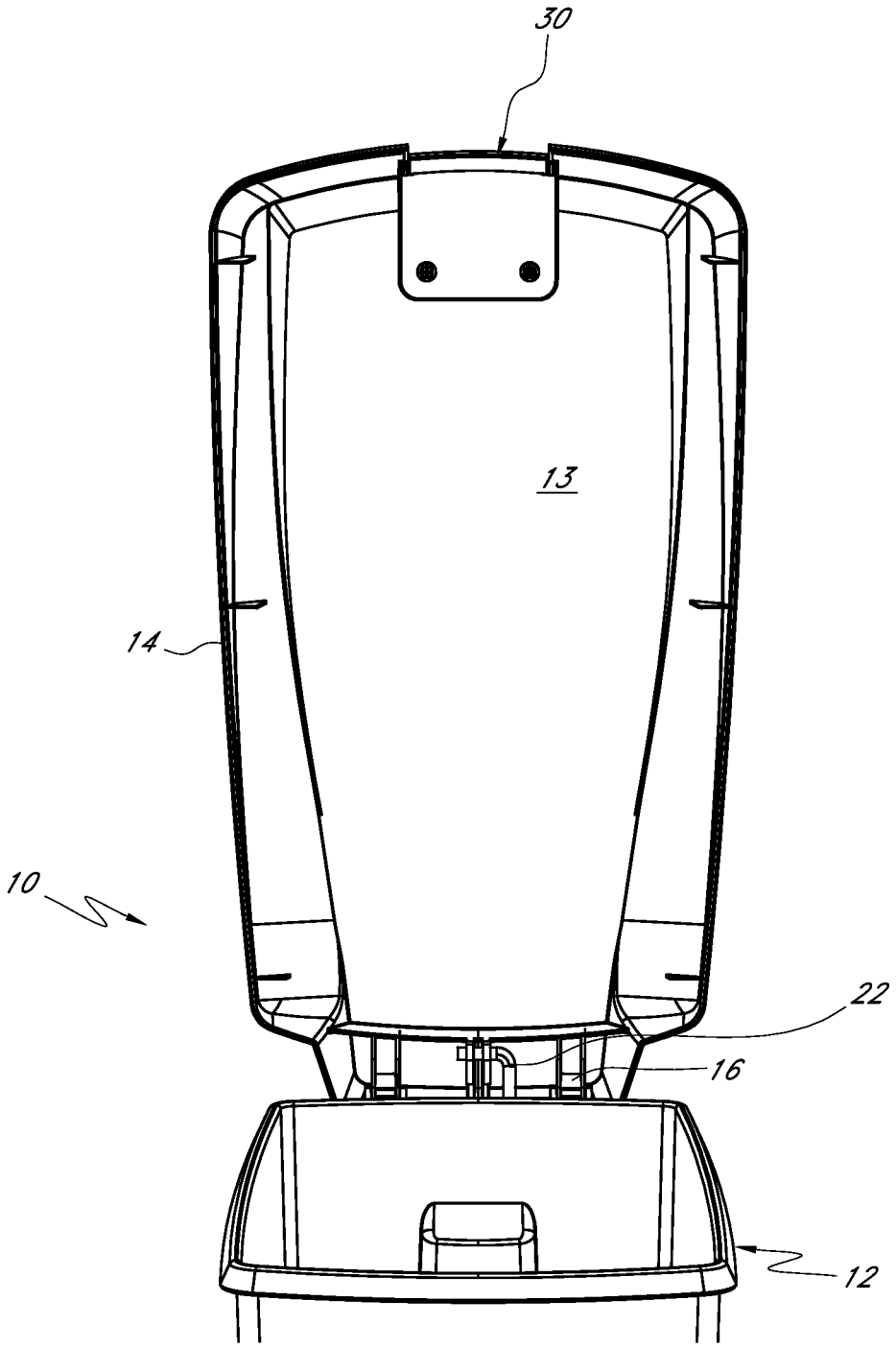
FIG. 16 is a front perspective view of the step trash can with the lid open, showing the underside of the lid with the latch in the lock position.

FIGS. 9, 11, 13 and 15 illustrate the lid latch mechanism 30 in the opened/unlock position. FIGS. 10, 12, 14 and 16 illustrate the lid latch mechanism 30 in the closed/lock position. FIGS. 15 and 16 illustrate the lid 14 opened from the body 12, showing the underside 13 of the lid 14. FIGS. 11 and 12 illustrate in greater detail the sliding movements of the latch 30 with respect to the lid 14. FIGS. 13 and 14 illustrate the top perspective view of the latch 30 with respect to the lid 14. FIGS. 9 and 10 illustrate the sliding movements of the latch 30 with respect to the body 12.

Referring to FIGS. 11, 12, 9A and 10A, the latch 30 can comprise a plate section 32, a bent section 34, and a lip 36. The bent section 34 can be exposed externally, as illustrated in FIG. 13, and can have a profile that is flush with the profile of the adjacent structure of the lid 12, thereby providing an aesthetically pleasing and appealing structure. The plate section 32 can be provided with two slotted holes 38. The plate section 32 can be slidably attached to the underside 13 of the lid 14 near the front edge thereof, by two retaining screws 40 anchored to the underside 13 of the lid 14.

The slotted hole 38 can be sized to allow the screws 40 to slide relatively within the slotted holes 38, thereby allowing the plate section 32 to slide relative to the edge of the lid 14, from the opened/unlock position shown in FIG. 11 to the closed/lock position shown in FIG. 12. Further, at the sides 48 of the bent section 34 of the latch 30 (see FIGS. 9A and 10A), slotted holes 50 can be provided to receive a stub 52 anchored at the adjacent section of the lid 14.

The slotted hole 50 can be sized to allow the stub 52 to slide relatively within the slotted holes 50, thereby further supporting sliding movement of the latch 30 (i.e., the sides 48 of the bent section 34 of the latch 30 to slide relative to the lid 14, from the open unlock position shown in FIG. 9A to the closed/lock position shown in FIG. 10A.

Detents 42*a* and 42*b* can be provided on the edges 41 at the front section of the lid 14. The plate section 32 of the latch 30 has at each side, extending spring tabs 44 that are biased outward away from the plate section 32. The tabs 44 can be provided with a detent with a rounded tip 46 that protrudes and can be received in the indentations 42*a* or 42*b*.

As the plate section 32 slides from an opened/unlock position to a closed/lock position, the tip 46 moves from a lodged position in indentation 42*a* as shown in FIG. 11, to be lodged in indentation 42*b* as shown in FIG. 12, thereby indexing the latch 30 from one position to another. The spring bias in the tab 44 is configured such that sufficient force is applied to lodge the tip 46 in the indentations 42*a* and 42*b* at the respective positions, to securely hold the latch 30 in place at the respective positions.

The periphery of the opening of the body 12 can have an outwardly extending flange or ledge 54. In the open/unlock position shown in FIG. 9A, the lip 36 of the latch 30 is released (i.e., does not catch) from the ledge 54, allowing the lid 14 to be opened with respect to the body 12. In the closed/lock position shown in FIG. 10A, the lip 36 of the latch 30 is latched onto (i.e., catches) the ledge 54, thereby locking the lid 14 against the body 12. Some embodiments, the ledge 54 is formed from an upper portion of the side wall of the body 12. The upper portion can extend hourly from the internal cavity defined by the body 12. Additionally, stiffening ribs (not shown) can extend between the ledge 54 and the outer surface of the body 12 to enhance the stiffness of the ledge 54.

While the above described embodiments are directed to deployment of the inventive latch in a step-type trash container having a pivoted lid, it is understood that the inventive latch can be used in a trash container that has a lid that is not attached to the container body, such as a lid that is removed or separated from the container body when opening the lid.

In some embodiments, the trash can 10 can include a damping mechanism 60 configured to dampen the movement of the lid 14. In some embodiments, the damping mechanism 60 can be disposed at an end of the lever member 24 connecting the pedal 20 with the linkage 22. In some embodiments, the linkage 22 can a lifting rod. The lifting rod 22 can be connected to an end of the lever member 24 that is opposite the pedal 20. As such, when a user depresses the pedal 20, the lever member 24 pivots about a pivot member 62, thereby causing the lifting rod 22 to rise and thereby open the lid 14.

Figure 5:
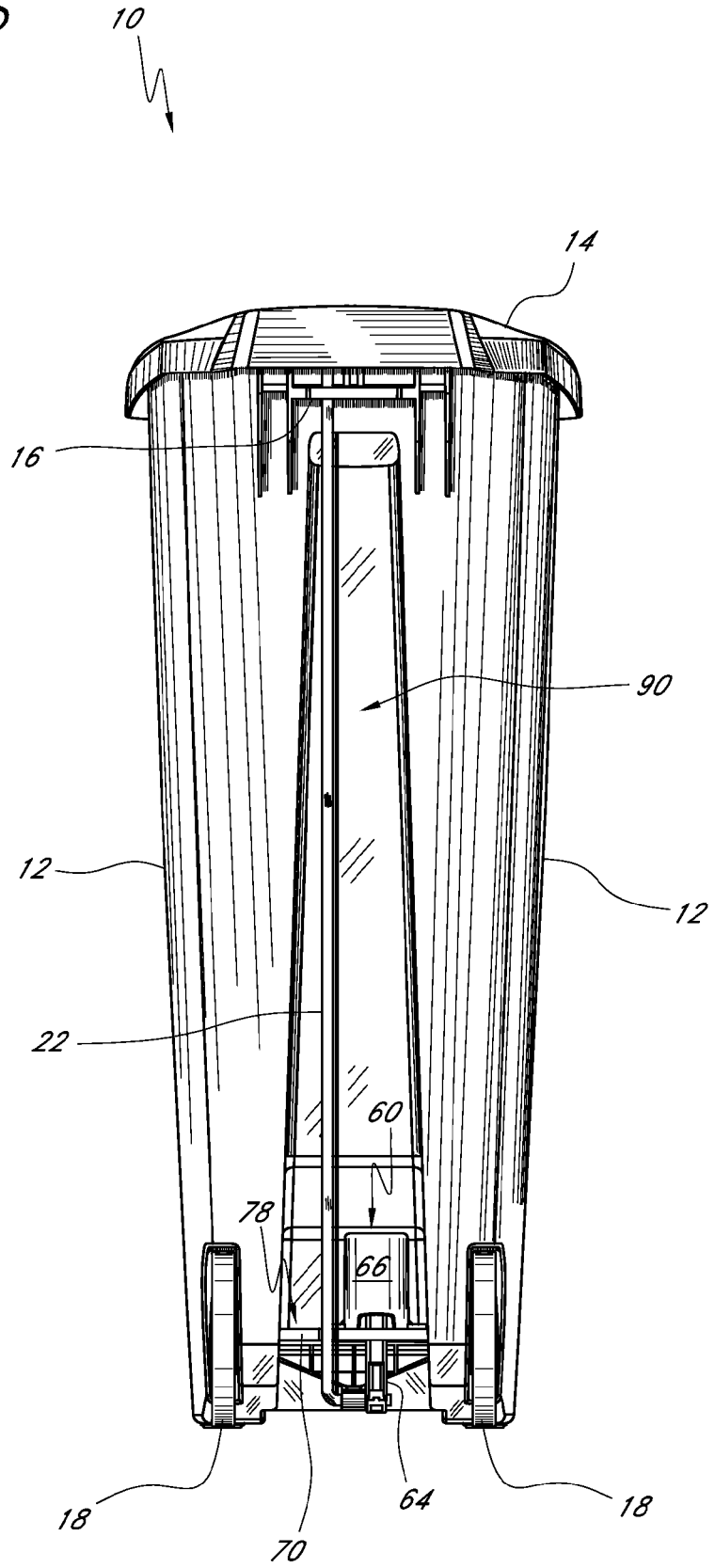
FIG. 5 is a rear view thereof.
Figure 6:
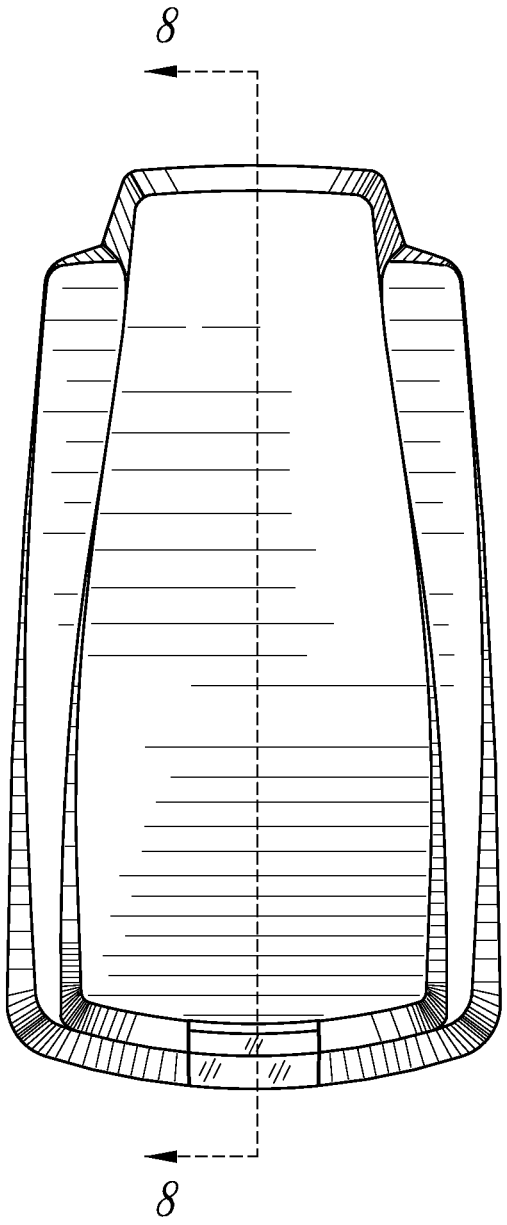
FIG. 6 is a top plan view thereof.

As shown in FIG. 5, the damping mechanism 60 can have a piston rod portion 64 and a cylinder portion 66. The construction and operation of this type of damping mechanism is disclosed in U.S. Patent Publication No. 2007/0012699 which is hereby incorporated by reference. Thus, a detailed description of the damping mechanism 60 is not included herein.

In some embodiments, the lower end of the piston rod 64 is also connected to the end of the lever member 24 that is opposite the pedal 20. In other embodiments, the lower end of the piston rod 64 is connected to an end of the lifting rod 22. As such, when a user steps on the pedal 20, the end of the lever member 24 connected to the lifting rod 22 rises, thereby opening the lid by raising the lifting rod 22, and causing the piston rod 64 to rise, thereby also moving the piston within the cylinder 66. As such, the damping mechanism provides resistance to the upward movement of the lifting rod 22. Additionally, the damping mechanism 60 dampens the movement of the lid toward the closed position by slowing the downward movement of the lifting rod 22. Due to the damping provided by the damping mechanism 60, the damping mechanism itself can experience significant loads.

Figure 17:
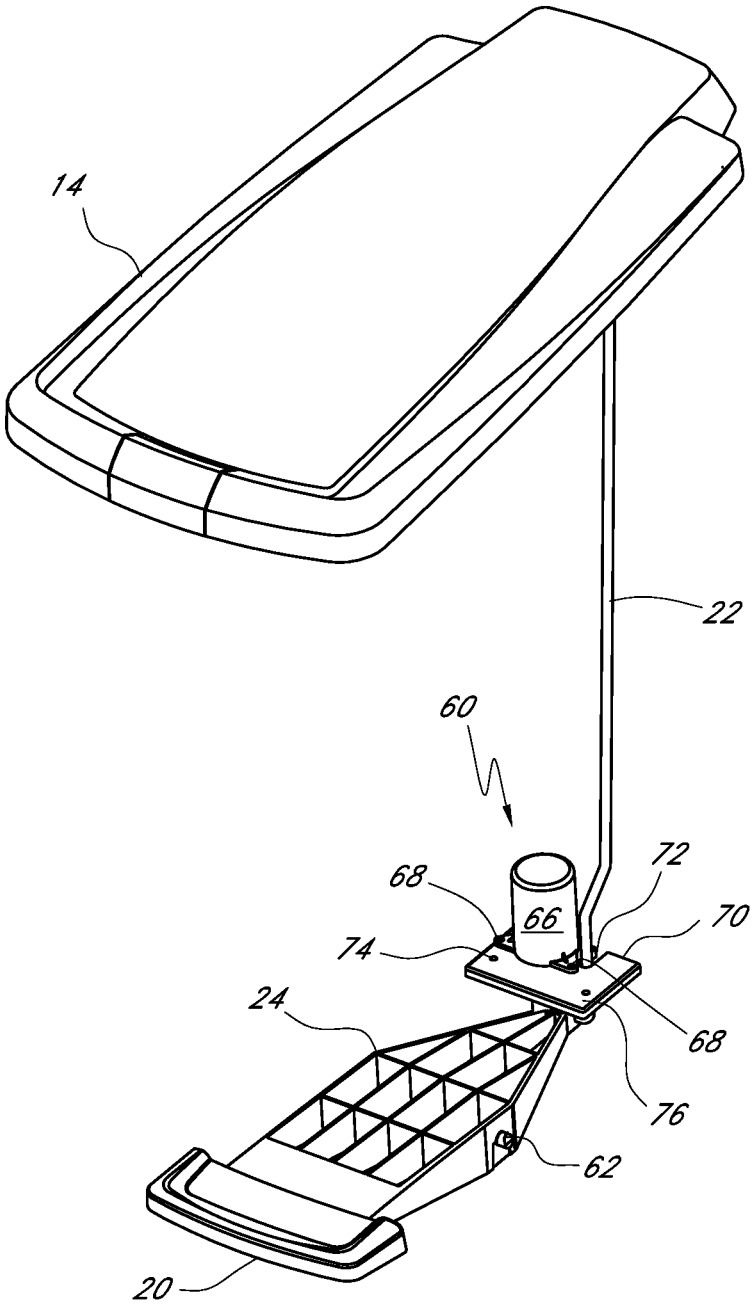
FIG. 17 is another right perspective view of the trash can, with the body and wheels removed.

With continued reference to FIG. 17, a cylinder portion 66 can include a plurality of flanges 68. The mounting flanges 68 can be used to secure the cylinder member 66 in a fixed position relative to the body 12.

Often, the bodies of trash can are made from softer, more malleable plastics, such as high impact polypropylene or other relatively softer plastic materials. However, other hardnesses can also be used.

Thus, because these types of plastics are soft, if the cylinder member 66 is attached directly to the body 12, the cylinder 66 is more likely to move or twist under the loads generated during operation of the pedal 20 and the closing movement of the lid 14. Additionally, such softer materials can fail from fatigue.

Thus, to provide a more secure and reliable attachment of the damping mechanism 62 to the body 12, the trash can also include a mounting platform 70. In some embodiments, the mounting platform can be made from material that is harder than the material used to make the body 12. For example, but without limitation, the mounting platform 70 can be made from Acrylonitrile Butadiene Styrene (ABS) plastic, or other materials.

The mounting platform 70 can include an opening 72 such as a groove or an aperture configured to allow the lifting rod 22 to freely move up and down as the user steps on or releases the pedal 20. Additionally, the cylinder member 66 can be attached to the mounting platform 70 using the flanges 68 and any type of fastener.

The mounting platform 70 can be connected to the body 12 in any known manner. In some environments, the mounting platform 70 can include apertures 74, 76 through which threaded fasteners can extend to attach the platform 70 to the body 12.

Figure 7:
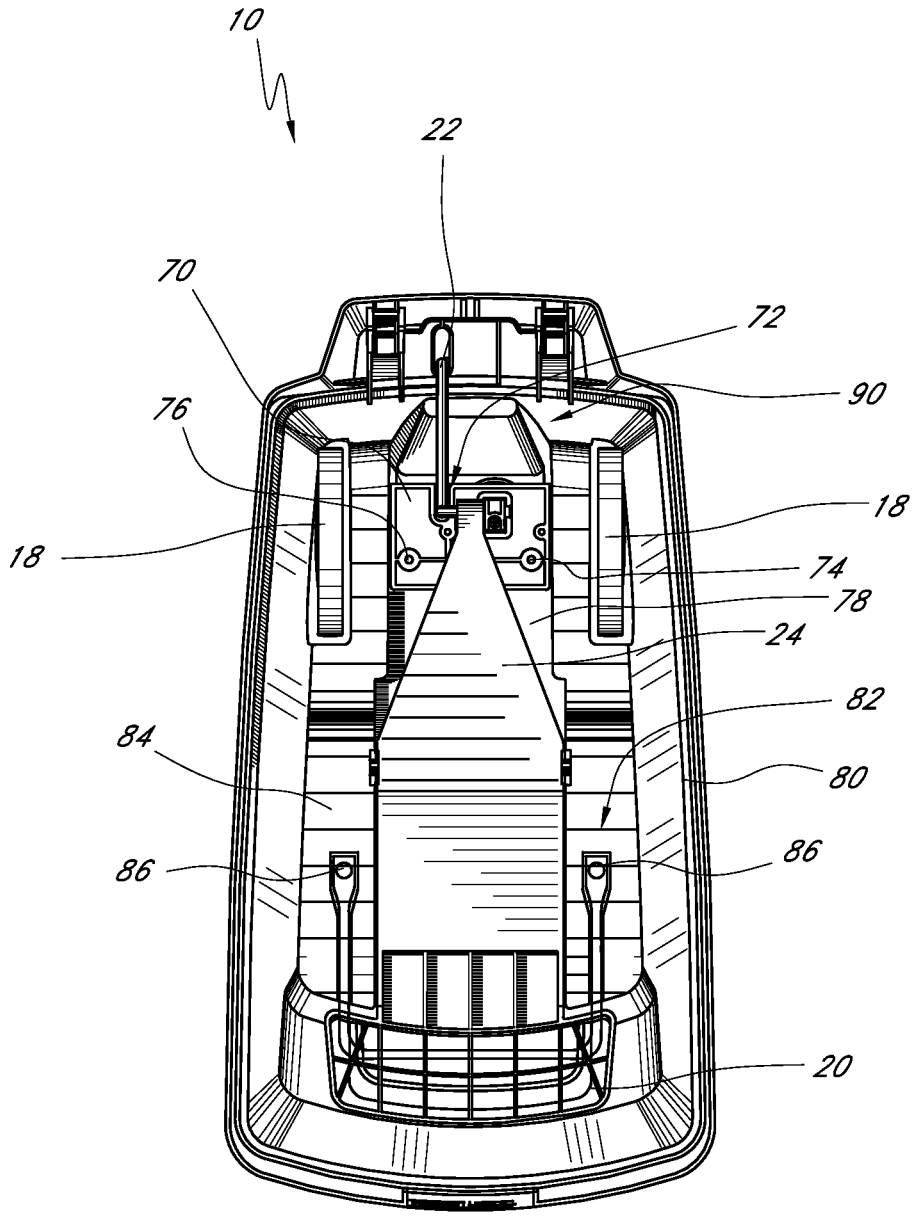
FIG. 7 is a bottom plan view thereof.
Figure 8:
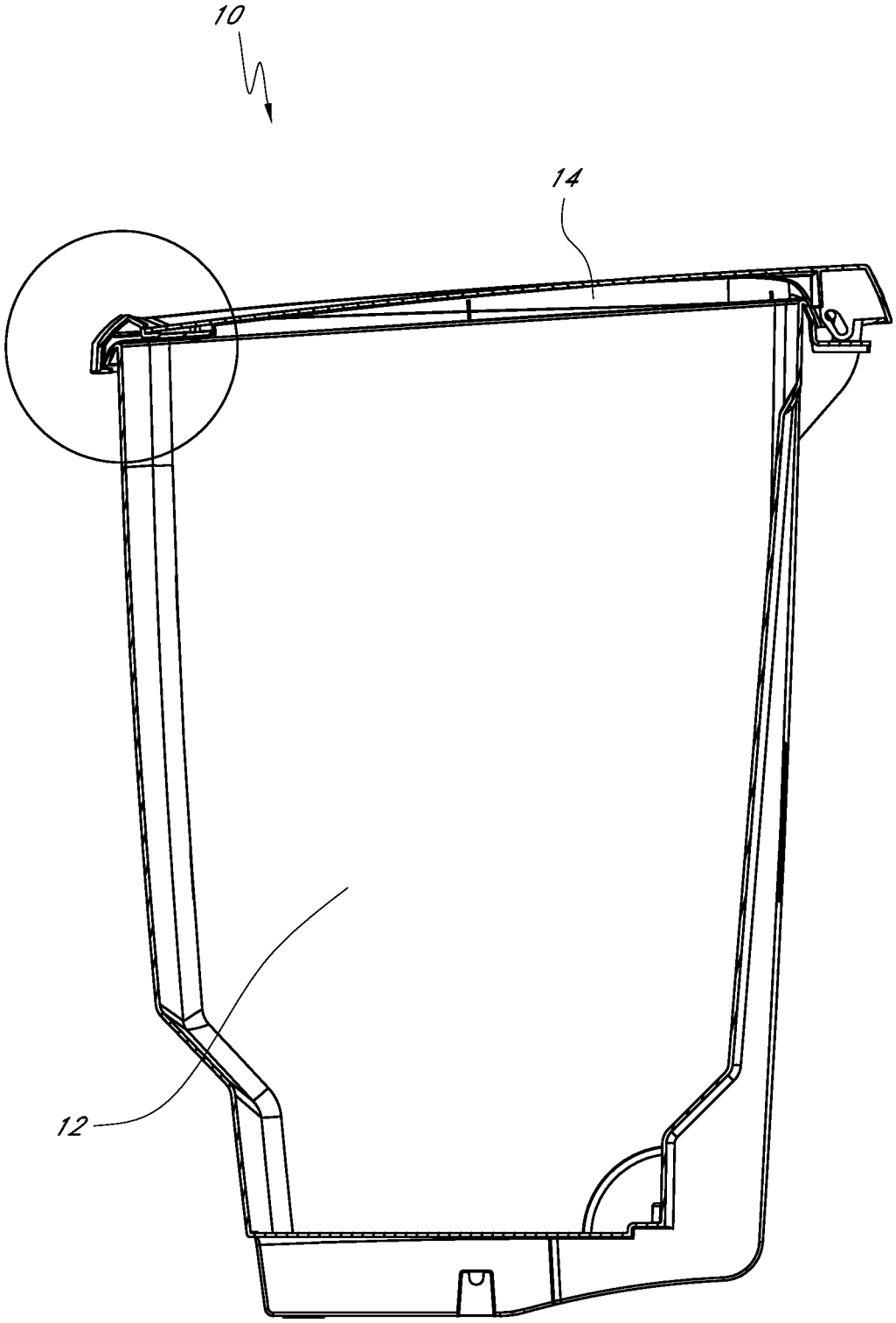
FIG. 8 is a sectional view taken along line 8-8 in FIG. 6.

In some embodiments, the body 12 can include a downwardly facing surface 78 (FIG. 7). The mounting platform 70 can be attached to the downwardly facing surface 78, for example, with fasteners extending through the holes 74, 76. Additionally, the mounting platform 70 can also be glued to the lower surface 78.

With the mounting platform 70 attached to the downwardly facing surface 78, when the pedal 20 is depressed and the lifting rod 22 and the piston rod 64 are raised, all of the associated forces imparted to the mounting platform 70 are transferred to the downwardly facing surface 78 of the body 12. This provides the attachment of the damping member 60 to the body 12 with enhanced strength that can better withstand the forces generated because a user can step on the pedal 20 with all of their weight. Thus, the upward movement of the piston rod 64 can be quite fast, and thus can cause significant forces on the mounting member 70.

When the pedal 20 is released, thereby allowing the lid 14 to close, the lifting rod 22 falls along with the piston rod 64. The devices within the cylinder member 66 slow this movement and thus also in part loads onto the plate 70. These loads are transferred to the body 12 through the fasteners and/or any other attachment means for attaching the plate 70 to the body 12.

In some embodiments where the plate 70 is made from a harder material than that used for the body 12, the plate 70 does not deform as much. Thus, the damping mechanism 60 performs more reliably and consistently.

In some embodiments, the trashcan 10 can be configured to be stackable. For example, the trashcan body 12 can have a tapered shape, expanding outwardly and upwardly. For example, as shown in the front elevational view of FIG. 3 and the right side elevational view of FIG. 4, the outer surfaces of the body 12 can be tapered outwardly and upwardly. As such, with the lid 14 removed, a plurality of the trashcan bodies 12 can be stacked one within another.

With reference to FIG. 7, the trashcan 10 can be configured such that the features near the bottom of the trashcan 10 fall entirely within a footprint of the upper portion of the side wall forming the body 12. For example, as shown in FIG. 7, the pedal 20 and the wheels 18, as seen in a bottom plan view, fall entirely within a periphery 80 defined by an upper portion of the side wall forming the body 12. As such, when one trashcan 10 is stacked within another, the pedal 20 and the wheels 18 can fit within the cavity of another trashcan.

In some embodiments, the trashcan 10 can include a pedal protector 82 (shown in phantom). The pedal protector 82 can be attached to the lower surface 84 of the body 12. In some embodiments, the pedal protector 82 can be fixed to the lower surface 84 with threaded fasteners, such as screws, extending through apertures a six disposed in tens of the protector 82. However, other devices can also be used for fixing the protector 82 to the lower surface 84.

Figure 4:
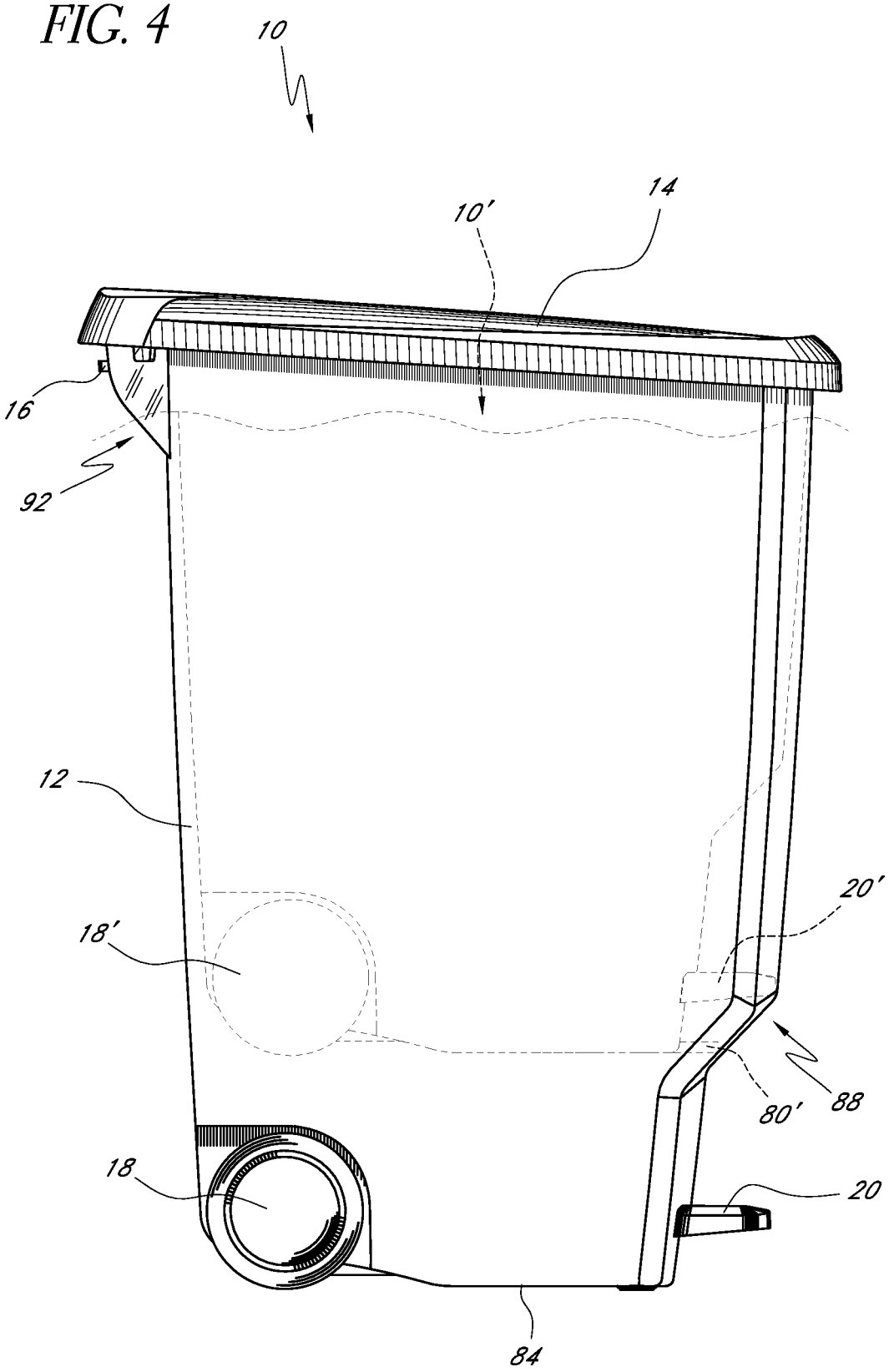
FIG. 4 is a left side view thereof.

The protector 82 can be in the form of a U-shaped bar. Additionally, the lower surface 84 can include a recessed channel (not shown) into which the protector 82 can fit. As shown in FIGS. 4 and 7, the bight of the protector 82 can be positioned so as to extend under the pedal 20. As such, when one trashcan 10' is stacked within another trashcan 10, the protector 80' can prevent the pedal 20' from contacting other portions of the interior of the trashcan 10.

In some embodiments, the trashcan 10 can include a brow portion 88 which extends over the pedal 20. In such embodiments, the interior surface of the brow portion 88, can serve as a resting place for the pedal protector 80' when the trashcan 10' is nested within the trashcan 10.

With continued reference to FIGS. 5 and 7, a rear surface of the body 12 can include a channel 90 configured to receive the lifting rod 22. As such, the lifting rod 22 is better protected when the trashcan 10 is stacked within another.

With reference to FIG. 4, the trashcan 10 can also include a rear projecting portion 92. The rear projecting portion can also help in protecting the lifting rod 22 when the trashcan 10 is stacked within another. For example, the projecting portion 92, when the trashcan 10 is stacked within another, will contact the upper peripheral edge of the body of another trashcan, thereby preventing any portion of the lifting rod 22 from contacting the upper peripheral edge of another trashcan.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combinations or sub-combinations of the specific features and aspects of the embodiments can be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A trash can comprising:

a trash can body comprising an outer periphery and an interior volume configured to receive trash, an outer rear surface of the trash can body having a recessed channel with a surface that is displaced in a frontward direction from a rear portion of the outer periphery of the trash can body, the surface comprising a first wall, a second wall, and a third wall, the third wall being intermediate the first and second walls in a front-to-rear direction and being at a different angle than the first and second walls, the trash can body including an upper opening sized such that trash can be inserted through the upper opening into the interior volume;

an opening mechanism positioned exterior to the trash can body, the opening mechanism comprising a foot pedal connected to a lifting rod;

a lid assembly pivotally attached relative to the trash can body so as to be movable between opened and closed positions when actuated by the foot pedal via the lifting rod, the lid assembly comprising a lid member sized to cover substantially the entire upper opening when the lid assembly is in the closed position; and a dampening device positioned exterior to a lower portion of the trash can body in a region where the foot pedal connects to the lifting rod and within the recessed channel on the outer rear surface of the trash can body, the dampening device configured to dampen movement of the lid assembly at least from the opened position toward the closed position wherein the recessed channel further comprises nested first and second portions, a front of the first portion being bound by the first wall and a front of the second portion being bound by the second wall, the dampening device being positioned in the second portion of the recessed channel.

2. The trash can according to claim 1, wherein the dampening device comprises a housing mounted to a bottom of the trash can body with a mounting member located between the housing and trash can body.

3. The trash can according to claim 2, wherein the trash can body is made from a first material and the mounting member made from a second material that is stiffer than the first material.

4. The trash can according to claim 3, wherein the first material is plastic.

5. The trash can according to claim 4, wherein the first material is impact resistant polypropylene.

6. The trash can according to claim 5, wherein the second material is ABS.

7. The trash can according to claim 2, wherein the mounting member includes an opening, a portion of the opening mechanism extending through the opening.

8. The trash can according to claim 2, wherein the housing is attached to the mounting member, and wherein a piston rod of the dampening device is attached to the opening mechanism.

9. The trash can according to claim 2, wherein the trash can body includes a downwardly facing surface, the mounting member being attached to the downwardly facing surface.

10. A method of manufacturing a trash can, the method comprising:

obtaining a trash can body having an outer surface defining an outer periphery and an interior volume configured to receive trash, a rear surface of the trash can body having a recessed channel comprising a surface displaced from the outer periphery of the trash can body and nested first and second portions, the surface comprising a first wall, a second wall that is spaced forward of the first wall, and a third wall that joins the first and second walls and is at a different angle than the first and second walls, the first portion of the recessed channel being bounded at least in part by the first wall and the second portion of the recessed channel being bounded at least in part by the second wall, the trash can body including an upper opening sized such that trash can be inserted through the upper opening into the interior volume;

attaching an opening mechanism to a lid assembly and exterior to the trash can body, such that actuation of the opening mechanism moves the lid assembly from the closed position to the open position, the opening mechanism comprising a foot pedal to a lifting rod;

attaching the lid assembly to the trash can body such that the lid assembly is movable between opened and closed positions when actuated by the foot pedal via the lifting rod, the lid assembly comprising a lid member sized to cover substantially the entire upper opening when the lid assembly is in the closed position; and positioning a dampening device exterior to a lower portion of the trash can body in a region where the foot pedal connects to the lifting rod and within the outer periphery of the trash can body and within the second portion of the recessed channel, the dampening device configured to dampen movement of the lid assembly at least from the opened position toward the closed position.

11. The method of claim 10, further comprising mounting a housing of the dampening device to a bottom of the trash can assembly with a mounting member located between the housing and the trash can body.

12. The method of claim 11, wherein the trash can body is made from a first material and the mounting member is made from a second material that is stiffer than the first material.

13. The method of claim 12, wherein the first material is plastic.

14. The method of claim 13, wherein the first material is impact resistant polypropylene.

15. The method of claim 14, wherein the second material is ABS.

16. The method of claim 11, further comprising extending a portion of the opening mechanism through an opening of the mounting member.

17. The method of claim 11, further comprising attaching the housing to the mounting member and attaching a piston rod of the dampening device to the opening mechanism.

18. The method of claim 11, further comprising attaching the mounting member to a downwardly facing surface of the trash can body.

19. The trash can according to claim 1, further comprising a lever member connecting the foot pedal and the lifting rod.

20. The trash can according to claim 19, wherein the dampening device is positioned at an end of the lever member.

21. The trash can according to claim 1, wherein the lower portion of the trash can falls entirely within a periphery defined by an upper portion of the trash can, such that when the trash can is stacked within another trash can having a same body, the lower portion of the trash can fits within a cavity of said another trash can.

22. The method of claim 10, further comprising connecting the foot pedal to the lifting rod with a lever member.

23. The method of claim 22, wherein positioning the dampening device comprises positioning the dampening device at an end of the lever member.

24. The trash can according to claim 1, wherein the dampening device is rigidly connected to a mounting platform.

25. The trash can according to claim 24, wherein:

the trash can further comprises a base;

in normal operation, the trash can is configured to rest on the base on generally horizontal ground and the upper opening is located above the base; and the mounting platform comprises a generally planar horizontal plate and the dampening device is mounted to an upper surface of the generally planar horizontal plate.

26. The trash can according to claim 24, wherein the dampening device is connected to the mounting platform using one of a plurality of flanges.

27. The trash can according to claim 24, wherein the mounting platform is positioned exterior to the lower portion of the trash can body in the region where the foot pedal connects to the lifting rod and within the recessed channel on the outer rear surface of the trash can body.

28. The method of claim 10, further comprising rigidly connecting the dampening device to a mounting platform.

29. The method of claim 27, wherein:

the trash can further comprises a base;

in normal operation, the trash can is configured to rest on the base on generally horizontal ground and the upper opening is located above the base; and the mounting platform comprises a generally planar horizontal plate and the dampening device is mounted to an upper surface of the generally planar horizontal plate.

30. The method of claim 27, wherein the mounting platform is positioned exterior to the lower portion of the trash can body in the region where the foot pedal connects to the lifting rod and within the recessed channel on the outer rear surface of the trash can body.

31. The trash can according to claim 1, wherein the trash can further comprises:

a generally horizontal base on which the trash can is configured to rest during normal operation; and a generally horizontal mounting plate, wherein the dampening device is connected to a top surface of the mounting plate and is positioned above a rear portion of the foot pedal.

32. The trash can according to claim 1, wherein the dampening device is connected to the trash can body with a mounting plate that extends from one side of the recessed channel to an opposite side of the recessed channel.

33. The trash can according to claim 1, wherein the third wall connects the first and second walls.

34. The trash can according to claim 1, wherein the first and second walls are generally parallel.

35. The trash can according to claim 1, wherein dampening device is completely positioned in the second portion of the recessed channel.

36. The trash can according to claim 1, wherein the second portion is further bounded at least in part by the third wall.

37. The trash can according to claim 1, wherein the lower portion of the trash can body further comprises a base on which the trash can is configured to rest on a substantially horizontal surface, wherein:

the angle of the first wall is at a first acute angle relative to the substantially horizontal surface;

the angle of the second wall is at a second acute angle relative to the substantially horizontal surface; and the angle of the third wall is at a third acute angle relative to the substantially horizontal surface, the third acute angle being less than the first acute angle and less than the second acute angle.

38. The method of claim 10, wherein the third wall is substantially planar.

39. The method of claim 10, further comprising positioning the dampening device completely inside the second portion of the recessed channel.

* * * * *